US010557344B2

(12) United States Patent
Kashikar et al.

(10) Patent No.: US 10,557,344 B2
(45) Date of Patent: Feb. 11, 2020

(54) DETERMINING GEOMETRIES OF HYDRAULIC FRACTURES

(71) Applicant: Reveal Energy Services, Inc., Houston, TX (US)

(72) Inventors: Sudhendu Kashikar, Katy, TX (US); Erica Coenen, Spring, TX (US); Sean Andrew Spicer, Houston, TX (US)

(73) Assignee: Reveal Energy Services, Inc., Houston, TX (US)

( * ) Notice: Subject to any disclaimer, the term of this patent is extended or adjusted under 35 U.S.C. 154(b) by 140 days.

(21) Appl. No.: 15/915,303

(22) Filed: Mar. 8, 2018

(65) Prior Publication Data

US 2018/0258760 A1 Sep. 13, 2018

Related U.S. Application Data

(60) Provisional application No. 62/468,847, filed on Mar. 8, 2017.

(51) Int. Cl.

| | |
|---|---|
| ***E21B 49/00*** | (2006.01) |
| ***E21B 47/06*** | (2012.01) |
| ***E21B 41/00*** | (2006.01) |
| ***E21B 43/26*** | (2006.01) |
| ***E21B 33/134*** | (2006.01) |

(52) U.S. Cl.

CPC ..... *E21B 49/00* (2013.01); *E21B 33/134* (2013.01); *E21B 41/0092* (2013.01); *E21B 43/26* (2013.01); *E21B 47/06* (2013.01)

(58) Field of Classification Search

CPC .... E21B 49/00; E21B 33/134; E21B 41/0092; E21B 43/26; E21B 47/06

See application file for complete search history.

(56) References Cited

U.S. PATENT DOCUMENTS

| | | | | |
|---|---|---|---|---|
| 5,431,227 | A | 7/1995 | Montgomery et al. | |
| 6,776,235 | B1 * | 8/2004 | England | E21B 43/267 166/271 |
| 8,439,116 | B2 | 5/2013 | East et al. | |
| 9,187,992 | B2 * | 11/2015 | Cherian | E21B 43/17 |
| 9,809,742 | B2 * | 11/2017 | Zhou | C09K 8/685 |
| 9,988,895 | B2 | 6/2018 | Roussel et al. | |

(Continued)

*Primary Examiner* — Yong-Suk Ro

(74) *Attorney, Agent, or Firm* — Fish & Richardson P.C.

(57) ABSTRACT

A wellbore system includes a first fracture formed from a wellbore at a first location; a second fracture formed from the wellbore at a second location; a wellbore seal positioned in the wellbore between the first and second locations and configured to fluidly seal a first portion from a second portion of the wellbore; a pressure gauge positioned in the first portion; a pressure gauge positioned in or uphole of the second portion; and a control system configured to communicably couple to the pressure gauges. The control system performs operations including identifying a set of first pressure values recorded by the pressure gauge in the first portion during a hydraulic fracturing operation; identifying at least one second pressure value recorded by the pressure gauge positioned in the second portion during the hydraulic fracturing operation; based on the set of first pressure values and the second pressure value, determining fracture geometries of the second hydraulic fracture; and generating a graphical representation of the fracture geometries.

37 Claims, 17 Drawing Sheets

(56) References Cited

U.S. PATENT DOCUMENTS

| | | | | |
|---|---|---|---|---|
| 9,988,900 | B2 | 6/2018 | Kampfer et al. | |
| 10,030,497 | B2 | 7/2018 | Dawson et al. | |
| 10,215,014 | B2 * | 2/2019 | Dawson | E21B 47/06 |
| 2009/0145660 | A1 | 6/2009 | Johnson et al. | |
| 2009/0188665 | A1 | 7/2009 | Tubel et al. | |
| 2009/0281776 | A1 | 11/2009 | Cheng et al. | |
| 2010/0004906 | A1 | 1/2010 | Searles et al. | |
| 2012/0296619 | A1 | 11/2012 | Maliassov et al. | |
| 2013/0140031 | A1 | 6/2013 | Cohen et al. | |
| 2014/0067353 | A1 | 3/2014 | Shelley et al. | |
| 2015/0075777 | A1 | 3/2015 | Walters et al. | |
| 2015/0075779 | A1 | 3/2015 | Walters et al. | |
| 2015/0083398 | A1 | 3/2015 | Dawson | |
| 2015/0176394 | A1 | 6/2015 | Roussel et al. | |
| 2015/0241584 | A1 | 8/2015 | Aarre | |
| 2016/0061022 | A1 | 3/2016 | McCoy | |
| 2016/0177693 | A1 | 6/2016 | Gomaa et al. | |
| 2016/0333680 | A1 | 11/2016 | Richter et al. | |
| 2017/0002652 | A1 | 1/2017 | Kampfer et al. | |
| 2017/0122077 | A1 | 5/2017 | Shahri et al. | |
| 2017/0145793 | A1 | 5/2017 | Ouenes | |
| 2017/0247995 | A1 | 8/2017 | Crews et al. | |
| 2017/0370208 | A1 | 12/2017 | Dawson | |
| 2018/0003033 | A1 | 1/2018 | Dawson | |
| 2018/0135401 | A1 | 5/2018 | Dykstra et al. | |
| 2019/0024489 | A1 * | 1/2019 | Nguyen | C09K 8/80 |
| 2019/0162871 | A1 * | 5/2019 | Dell | G01V 3/30 |

* cited by examiner

DETERMINING GEOMETRIES OF HYDRAULIC FRACTURES

CROSS-REFERENCE TO RELATED APPLICATION

This application claims priority under 35 U.S.C. § 119 to U.S. Provisional Patent Application Ser. No. 62/468,847, filed on Mar. 8, 2017, and entitled "Mapping of Fracture Geometries in a Single Well Stimulation," the entire contents of which are incorporated by reference herein.

TECHNICAL FIELD

This specification relates to systems and method for determining geometries of hydraulic fractures formed in one or more underground rock formations.

BACKGROUND

Certain geologic formations, such as unconventional reservoirs in shale, sandstone, and other rock types, often exhibit increased hydrocarbon production subsequent to one or more completion operations being performed. One such completion operation may be a hydraulic fracturing operation, in which a liquid is pumped into a wellbore to contact the geologic formation and generate fractures throughout the formation due to a pressure of the pumped liquid (e.g., that is greater than a fracture pressure of the rock formation). In some cases, an understanding of a size or other characteristics of the generated hydraulic fractures may be helpful in understanding a potential hydrocarbon production from the geologic formation.

SUMMARY

In a general implementation according to the present disclosure, a wellbore system includes a first hydraulic fracture formed from a wellbore; a second hydraulic fracture formed from the wellbore at a second location of the wellbore; at least one wellbore seal positioned in the wellbore between the first and second locations and configured to fluidly seal a first portion of the wellbore that includes the first location from a second portion of the wellbore that includes the second location; a pressure gauge positioned in the first portion of the wellbore; a pressure gauge positioned in or uphole of the second portion of the wellbore; and a control system configured to communicably couple to the pressure gauges. The control system is configured to perform operations including identifying a set of first pressure values recorded by the pressure gauge positioned in the first portion of the wellbore during a hydraulic fracturing operation that forms the second hydraulic fracture; identifying at least one second pressure value recorded by the pressure gauge positioned in the second portion of the wellbore during the hydraulic fracturing operation that forms the second hydraulic fracture; based on the identified set of first pressure values and the at least one second pressure value, determining one or more fracture geometries of the second hydraulic fracture; and generating a graphical representation of the one or more fracture geometries of the second hydraulic fracture for display on a graphical user interface.

In an aspect combinable with the example implementation, the at least one wellbore seal includes a first wellbore seal, the system further including a second wellbore seal positioned in the wellbore between the first portion of the wellbore and another portion of the wellbore between the first hydraulic fracture and a toe of the wellbore and configured to fluidly seal the first portion of the wellbore that includes the first location from the toe of the wellbore.

Another aspect combinable with any of the previous aspects further includes a third wellbore seal positioned in the wellbore between the second portion of the wellbore and a third portion of the wellbore that includes a third location of the wellbore and configured to fluidly seal the second portion of the wellbore from the third portion of the wellbore.

In another aspect combinable with any of the previous aspects, the third portion of the wellbore is uphole of the second portion of the wellbore.

Another aspect combinable with any of the previous aspects further includes a third hydraulic fracture formed from the wellbore at the third location; and a pressure gauge positioned in or uphole of the third portion of the wellbore.

In another aspect combinable with any of the previous aspects, the control system is configured to perform further operations including identifying a set of second pressure values recorded by the pressure gauge positioned in the second portion of the wellbore during a hydraulic fracturing operation that forms the third hydraulic fracture; identifying at least one third pressure value recorded by the pressure gauge positioned in or uphole of the third portion of the wellbore during the hydraulic fracturing operation that forms the third hydraulic fracture; based on the at least one third pressure value and at least one of: (i) the identified set of first pressure values, or (ii) the identified set of second pressure values, determining one or more fracture geometries of the third hydraulic fracture; and generating a graphical representation of the one or more fracture geometries of the third hydraulic fracture for display on a graphical user interface.

In another aspect combinable with any of the previous aspects, the operation of determining one or more fracture geometries of the third hydraulic fracture includes based on the at least one third pressure value, the identified set of first pressure values, and the identified set of second pressure values, determining one or more fracture geometries of the third hydraulic fracture.

In another aspect combinable with any of the previous aspects, the at least one wellbore seal includes a bridge plug.

In another aspect combinable with any of the previous aspects, the pressure gauge positioned in or uphole of the second portion of the wellbore is positioned at or near an entry location of the wellbore at a terranean surface.

In another general implementation, a method for determining one or more hydraulic fracture geometries includes forming a first hydraulic fracture that emanates from a wellbore at a first location of the wellbore; fluidly sealing a first portion of the wellbore that includes the first location from a second portion of the wellbore that includes a second location of the wellbore; forming a second hydraulic fracture that emanates from the wellbore at the second location; during the formation of the second hydraulic fracture: (i) measuring a set of first pressure values recorded by a pressure gauge positioned in the first portion of the wellbore, and (ii) measuring at least one second pressure value recorded by a pressure gauge positioned in or uphole of the second portion of the wellbore; based on the measured set of first pressure values and the measured at least one second pressure value, determining one or more fracture geometries of the second hydraulic fracture; and generating a graphical representation of the one or more fracture geometries of the second hydraulic fracture for display on a graphical user interface.

Another aspect combinable with any of the previous aspects further includes fluidly sealing the first portion of the wellbore from another portion of the wellbore between the first hydraulic fracture and a toe of the wellbore.

Another aspect combinable with any of the previous aspects further includes fluidly sealing the second portion of the wellbore from a third portion of the wellbore that includes a third location of the wellbore.

In another aspect combinable with any of the previous aspects, the third portion of the wellbore is uphole of the second portion of the wellbore.

Another aspect combinable with any of the previous aspects further includes forming a third hydraulic fracture that emanates from the wellbore at the third location; during the formation of the third hydraulic fracture: (i) measuring a set of second pressure values recorded by a pressure gauge positioned in the second portion of the wellbore, and (ii) measuring at least one third pressure value recorded by a pressure gauge positioned in or uphole of the third portion of the wellbore; based on the measured set of second pressure values and the measured at least one third pressure value, determining one or more fracture geometries of the third hydraulic fracture; and generating a graphical representation of the one or more fracture geometries of the third hydraulic fracture for display on the graphical user interface.

In another aspect combinable with any of the previous aspects, fluidly sealing the first portion of the wellbore that includes the first location from the second portion of the wellbore that includes the second location of the wellbore includes setting a wellbore seal within the wellbore between the first and second locations.

In another aspect combinable with any of the previous aspects, the wellbore seal includes a bridge plug.

In another aspect combinable with any of the previous aspects, the pressure gauge positioned in or uphole of the second portion of the wellbore is positioned at or near an entry location of the wellbore at a terranean surface.

Another aspect combinable with any of the previous aspects further includes forming the wellbore that extends from a terranean surface into a subsurface rock formation.

In another example implementation, a structured data processing system for determining geometries of hydraulic fractures includes one or more hardware processors; a memory in communication with the one or more hardware processors, the memory storing a data structure and an execution environment. The data structure storing data that includes a plurality of hydraulic fracture identifiers and a plurality of observed fluid pressures, at least one of the plurality of hydraulic fracture identifiers associated with a first hydraulic fracture formed from a wellbore that extends from a terranean surface into a subsurface rock formation and at least another of the plurality of hydraulic fracture identifiers associated with a second hydraulic fracture formed from the wellbore. At least one of the plurality of observed fluid pressures includes a pressure change in a fluid in the first hydraulic fracture that is induced by formation of the second hydraulic fracture. The execution environment including a hydraulic fracture geometry solver configured to perform operations including (i) executing a single- or multi-objective, non-linear constrained optimization analysis to minimize at least one objective function associated with the plurality of observed fluid pressures, and (ii) based on minimizing the at least one objective function, determining respective sets of hydraulic fracture geometries associated with at least one of the first hydraulic fracture or the second hydraulic fracture. The system further includes a user interface module that generates a user interface that renders one or more graphical representations of the determined respective sets of hydraulic fracture geometries; and a transmission module that transmits, over one or more communication protocols and to a remote computing device, data that represents the one or more graphical representations.

In an aspect combinable with the example implementation, the at least one objective function includes a first objective function, and minimizing the first objective function includes minimizing a difference between the observed pressure and a modeled pressure associated with the first and second hydraulic fractures.

In another aspect combinable with any of the previous aspects, the hydraulic fracture geometry solver is further configured to perform operations including assessing a shift penalty to the first objective function.

In another aspect combinable with any of the previous aspects, the operation of assessing the shift penalty includes minimizing a standard deviation of a center location of each of a plurality of hydraulic fractures initiated from the wellbore that includes the second hydraulic fracture.

In another aspect combinable with any of the previous aspects, the modeled pressure is determined with a finite element method that outputs the modeled pressure based on inputs that include parameters of a hydraulic fracture operation and the respective sets of hydraulic fracture geometries of the first and second hydraulic fractures.

In another aspect combinable with any of the previous aspects, the hydraulic fracture geometry solver is further configured to perform operations including minimizing a second objective function associated with at least one of an area of the first or second hydraulic fracture.

In another aspect combinable with any of the previous aspects, the operation of minimizing the second objective function includes minimizing a difference between the area of the first hydraulic fracture and an average area of a group of hydraulic fractures that includes the second hydraulic fracture; or minimizing a difference between the area of the second hydraulic fracture and an average area of the group of hydraulic fractures that includes the second hydraulic fracture.

In another aspect combinable with any of the previous aspects, the hydraulic fracture geometry solver is further configured to perform operations including applying a constraint to the single- or multi-objective, non-linear constrained optimization analysis associated with at least one of a center of the first hydraulic fracture or a center of the second hydraulic fracture.

In another aspect combinable with any of the previous aspects, the operation of applying the constraint includes at least one of constraining a distance between the center of the first hydraulic fracture and the radial center of the wellbore to be no greater than a fracture half-length dimension of the first hydraulic fracture and no greater than a fracture height dimension of the first hydraulic fracture; or constraining a distance between the center of the second hydraulic fracture and the radial center of the wellbore to be no greater than a fracture half-length dimension of the second hydraulic fracture and no greater than a fracture height dimension of the second hydraulic fracture.

In another aspect combinable with any of the previous aspects, the hydraulic fracture geometry solver is further configured to perform operations including iterating steps (i) and (iii) until at least one of (a) the value of at least one of the first or second objective functions is less than a specified value; (b) the value of at least one of the first or second objective functions is greater than a specified value; (c) a ratio of at least one of the first or second objective functions to a specified value is a finite number; (d) the ratio of a specified number to at least one of the first or second objective functions is a finite number; or (e) a change in the determined plurality of fracture geometry data for the first hydraulic fracture from a previous iteration to a current iteration is less than the specified value.

In another aspect combinable with any of the previous aspects, the hydraulic fracture geometry solver is further configured to perform operations including iterating steps (i) and (iii) until a change in the determined plurality of fracture geometry data for the first hydraulic fracture from a previous iteration to a current iteration is less than the specified value and at least one of (a) the value of at least one of the first or second objective functions is less than a specified value; (b) the value of at least one of the first or second objective functions is greater than a specified value; (c) a ratio of at least one of the first or second objective functions to a specified value is a finite number; or (d) the ratio of a specified number to at least one of the first or second objective functions is a finite number.

In another aspect combinable with any of the previous aspects, the operation of iterating includes setting the set of hydraulic fracture geometries of the first hydraulic fracture to an initial set of data values; minimizing at least one of the first or second objective functions using the observed pressure and modeled pressure that is based on the set of hydraulic fracture geometries of the first hydraulic fracture and a set of hydraulic fracture geometries of the second hydraulic fracture; calculating a new set of hydraulic fracture geometries of the first hydraulic based on the minimization; and resetting the set of hydraulic fracture geometries of the first hydraulic fracture to the calculated new set of hydraulic fracture geometries.

In another aspect combinable with any of the previous aspects, the operation of determining respective sets of hydraulic fracture geometries associated with at least one of the first hydraulic fracture or the second hydraulic fracture includes determining respective sets of hydraulic fracture geometries associated with the first hydraulic fracture.

In another aspect combinable with any of the previous aspects, the hydraulic fracture geometry solver is further configured to perform operations including based on the error for at least one of the first or second objective functions being less than the specified value, fixing the set of hydraulic fracture geometries of the first hydraulic fracture to the calculated new set of hydraulic fracture geometries; minimizing the first objective function to minimize the difference between the observed pressure and the modeled pressure associated with the first and second hydraulic fractures; and minimizing the second objective function to minimize the difference between the area of the second hydraulic fracture and the average area of the group of hydraulic fractures that includes the second hydraulic fracture.

In another aspect combinable with any of the previous aspects, the hydraulic fracture geometry solver is further configured to perform operations including iterating steps (i) and (ii) until an error for at least one of the first or second objective functions is less than a specified value; and a change in the determined plurality of fracture geometry data for the second hydraulic fracture from a previous iteration to a current iteration is less than the specified value.

In another aspect combinable with any of the previous aspects, the operation of iterating includes setting the set of hydraulic fracture geometries of the second hydraulic fracture to an initial set of data values; minimizing at least one of the first or second objective functions using the observed pressure and modeled pressure that is based on the fixed set of hydraulic fracture geometries of the first hydraulic fracture and the set of hydraulic fracture geometries of the second hydraulic fracture; calculating a new set of hydraulic fracture geometries of the second hydraulic fracture based on the minimization; and resetting the set of hydraulic fracture geometries of the second hydraulic fracture to the calculated new set of hydraulic fracture geometries.

In another aspect combinable with any of the previous aspects, the single- or multi-objective, non-linear constrained optimization analysis includes a sequential quadratic programming method.

In another aspect combinable with any of the previous aspects, the data structure includes an observation graph that includes a plurality of nodes and a plurality of edges, each edge connecting two nodes.

In another aspect combinable with any of the previous aspects, each node represents one of the plurality of hydraulic fractures and each edge represents one of the observed pressures.

Implementations of a hydraulic fracturing geometric modeling system according to the present disclosure may include one, some, or all of the following features. For example, implementations may more accurately determine hydraulic fracture dimensions, thereby informing a fracture treatment operator about one or more effects of particular treatment parameters. As another example, implementations may inform a fracture treatment operator about more efficient or effective well spacing (e.g., horizontally and vertically) in an existing or future production field. As yet another example, implementations may inform a fracture treatment operator about more efficient or effective well constructions parameters, such as well cluster count and well cluster spacing (e.g., horizontally and vertically).

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1A:
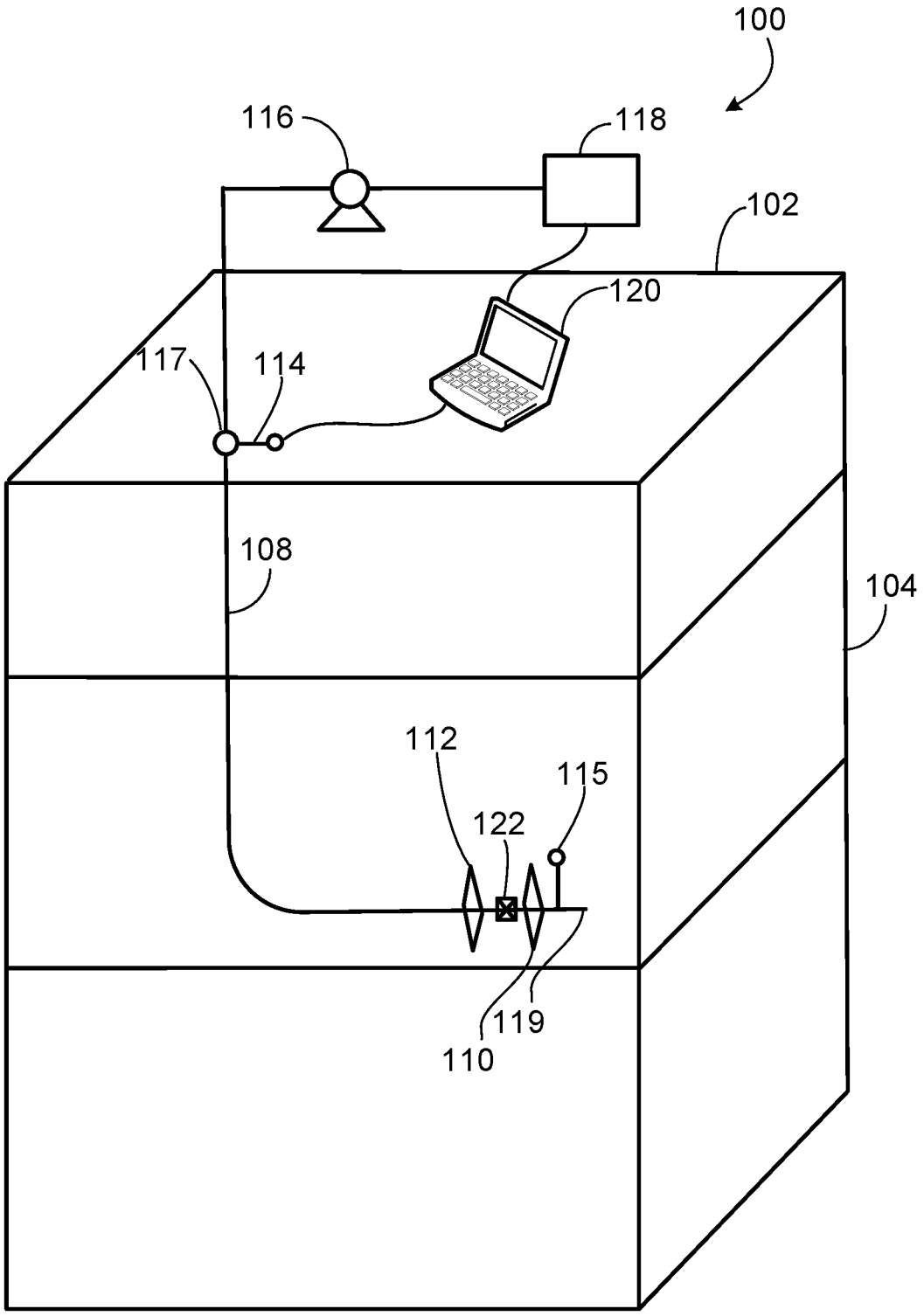
FIGS. 1A-1C are schematic illustrations of an example implementation of a hydraulic fracture geometric modeling system within a hydraulic fracturing system.
Figure 1B:
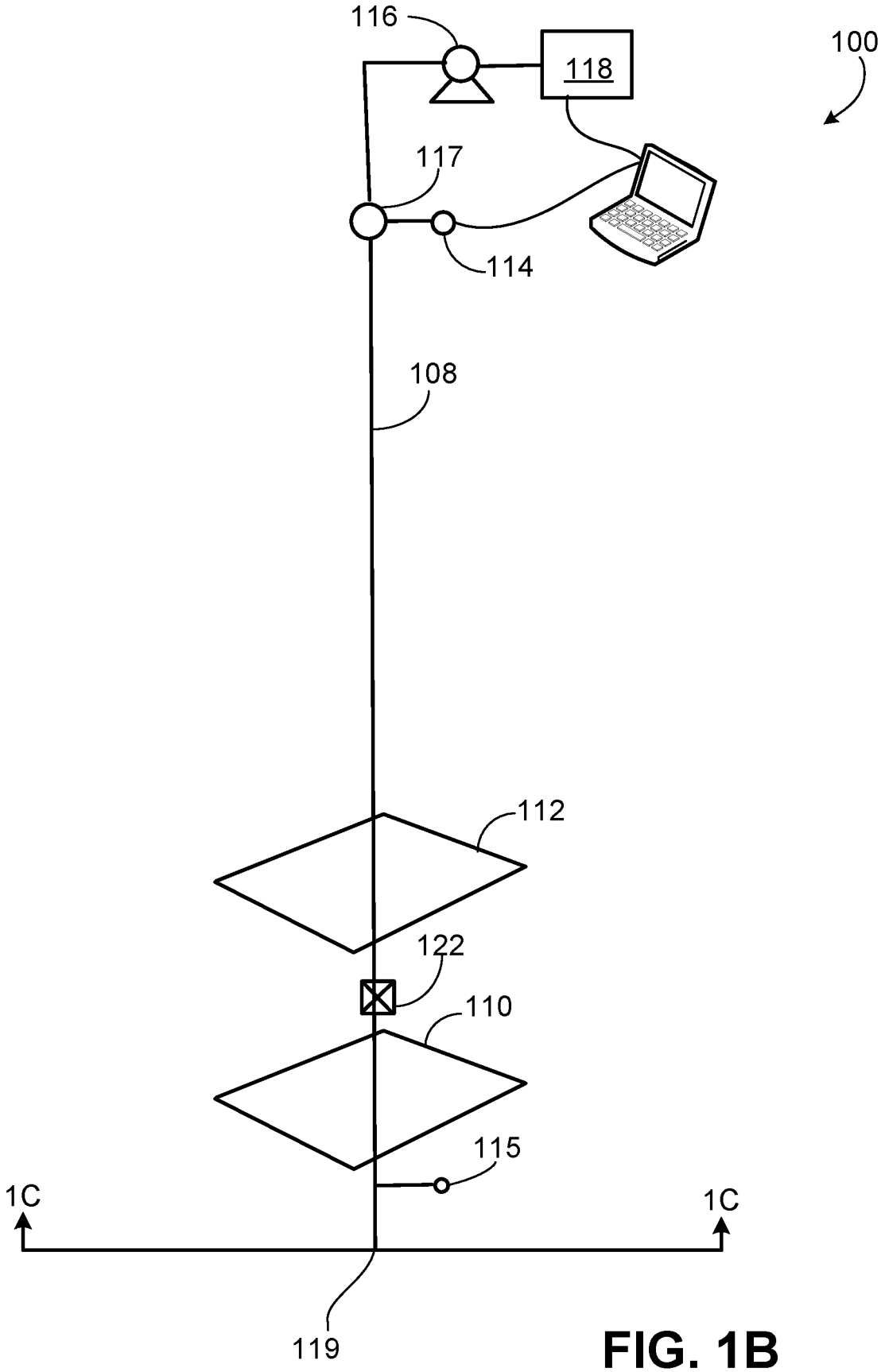
Figure 1C:
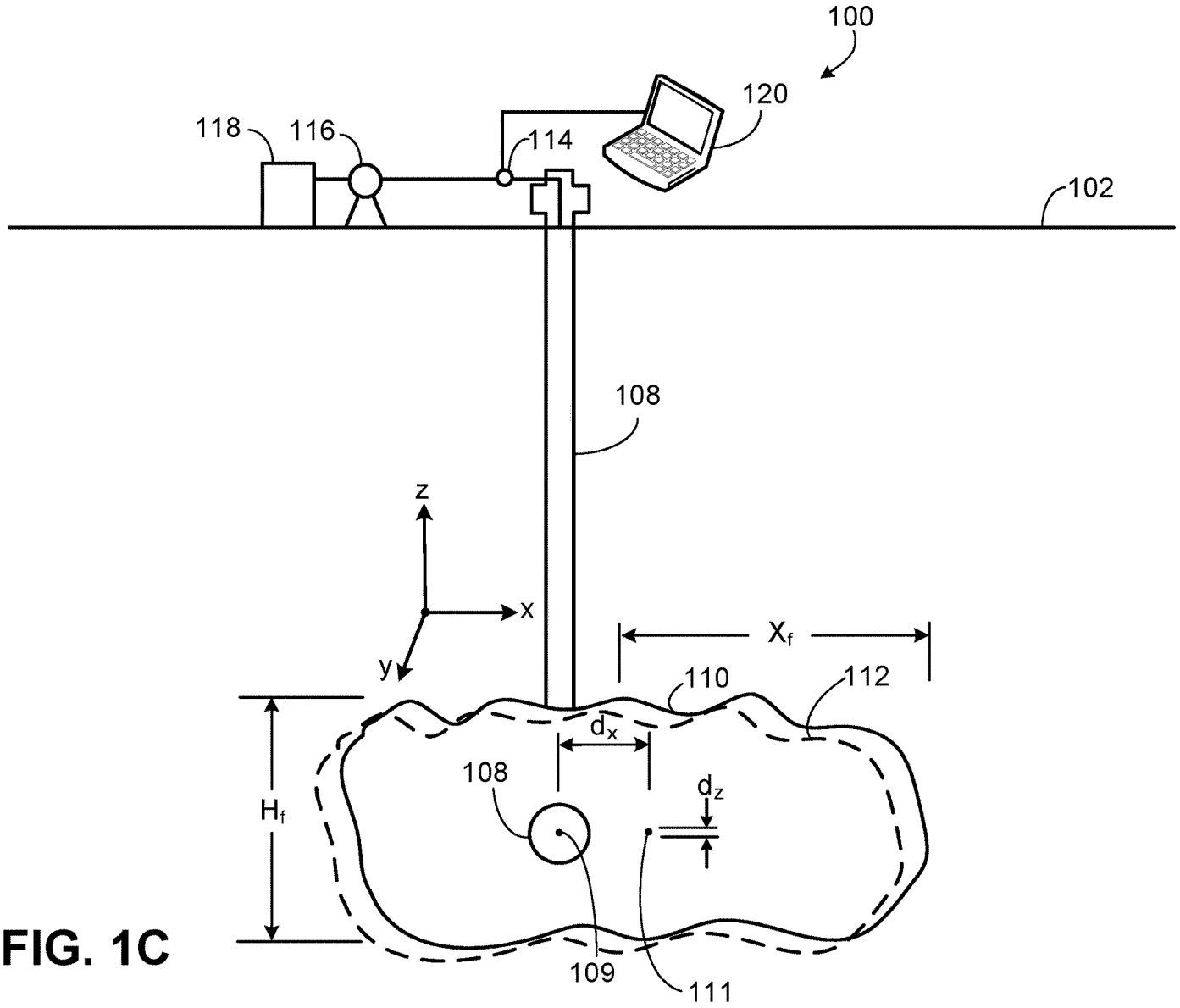

FIGS. 1A-1C are schematic illustrations of an example implementation of a hydraulic fracture geometric modeling system 120 within a hydraulic fracturing system 100. As shown, system 100 includes a wellbore 108 (e.g., cased or open hole or a combination thereof) that is formed from a terranean surface 102 to a subterranean zone 104 located below the terranean surface 102. The wellbore 108, generally, includes a seal 122 (e.g., a packer or bridge plug or other fluid barrier) positioned in the wellbore 108, a pressure sensor 114, and a pressure sensor 115. In the example implementation, a toe 119 of the wellbore 108 is located at a downhole end of the wellbore 108, while an entry 117 is located at an uphole end of the wellbore 108.

In this example, the pressure sensor 114 is located at or near a wellhead on the wellbore 108 but in alternate implementations, the pressure sensor 114 may be positioned within the wellbore 108 below the terranean surface 102, such as uphole of the seal 122 (e.g., between the seal 122 and the entry 117). As further shown, the pressure sensor 115 is positioned at or near the toe 119 of the wellbore 108. In alternative implementations, the pressure sensor 115 may be positioned downhole of the seal 122 (e.g., between the seal 122 and the toe 119 of the wellbore 108).

One or both of the pressure sensors 114 or 115 may be a pressure gauge that transmits pressure data (e.g., measured during one or more hydraulic fracture operations) to a hydraulic fracture geometric modeling system 120 that is communicably coupled (e.g., through a downhole conductor, such as a fiber optic line or otherwise) to the pressure sensors 114 and 115. In alternative implementations, one or both of the pressure sensors 114 or 115 may measure and store pressure data (e.g., measured during one or more hydraulic fracture operations). Once retrieved to the terranean surface 102, the pressure data may be recovered by the hydraulic fracture geometric modeling system 120.

Generally, according to the present disclosure, the pressure sensors 114 and 115 may be used to measure pressure variations (at different locations) in a fluid (or fluids) contained in the wellbore 108 and/or one or more hydraulic fractures 110 formed from the wellbore 108 that are induced by a hydraulic fracturing fluid pumped into the wellbore 108 to form one or more hydraulic fractures 112 formed from the treatment wellbore 108. Such induced pressure variations, as explained more fully below, may be used to determine a fracture growth curve and other information regarding the hydraulic fractures 110 and 112.

The wellbore 108 shown in FIG. 1A includes vertical and horizontal sections, as well as a radiussed section (also referred to as a "heel") that connects the vertical and horizontal portions. Generally, and in alternative implementations, the wellbore 108 can include horizontal, vertical (e.g., only vertical), slant, curved, and other types of wellbore geometries and orientations. The wellbore 108 may include a casing (not shown) that is cemented or otherwise secured to the wellbore wall to define a borehole in the inner volume of the casing. In alternative implementations, the wellbore 108 can be uncased or include uncased sections. Perforations (not specifically labeled) can be formed in the casing to allow fracturing fluids and/or other materials to flow into the wellbore 108. Perforations can be formed using shape charges, a perforating gun, and/or other tools. Although illustrated as generally vertical portions and generally horizontal portions, such parts of the wellbore 108 may deviate from exactly vertical and exactly horizontal (e.g., relative to the terranean surface 102) depending on the formation techniques of the wellbore 108, type of rock formation in the subterranean formation 104, and other factors. Generally, the present disclosure contemplates all conventional and novel techniques for forming the wellbore 108 from the surface 102 into the subterranean formation 104.

The treatment wellbore 108 shown in FIG. 1A includes vertical and horizontal sections, as well as a radiussed section that connects the vertical and horizontal portions. Generally, and in alternative implementations, the wellbore 108 can include horizontal, vertical (e.g., only vertical), slant, curved, and other types of wellbore geometries and orientations. The treatment wellbore 108 may include a casing (not shown) that is cemented or otherwise secured to the wellbore wall to define a borehole in the inner volume of the casing. In alternative implementations, the wellbore 108 can be uncased or include uncased sections. Perforations (not specifically labeled) can be formed in the casing to allow fracturing fluids and/or other materials to flow into the wellbore 108. Perforations can be formed using shape charges, a perforating gun, and/or other tools.

The example hydraulic fracturing system 100 includes a hydraulic fracturing liquid circulation system 118 that is fluidly coupled to the wellbore 108. In some aspects, the hydraulic fracturing liquid circulation system 118, which includes one or more pumps 116, is fluidly coupled to the subterranean formation 104 (which could include a single formation, multiple formations or portions of a formation) through a working string (not shown). Generally, the hydraulic fracturing liquid circulation system 118 can be deployed in any suitable environment, for example, via skid equipment, a marine vessel, sub-sea deployed equipment, or other types of equipment and include hoses, tubes, fluid tanks or reservoirs, pumps, valves, and/or other suitable structures and equipment arranged to circulate a hydraulic fracturing liquid through the wellbore 108 and into the subterranean formation 104 to generate the one or more fractures 110 and 112. The working string is positioned to communicate the hydraulic fracturing liquid into the wellbore 108 and can include coiled tubing, sectioned pipe, and/or other structures that communicate fluid through the wellbore 108. The working string can also include flow control devices, bypass valves, ports, and or other tools or well devices that control the flow of fracturing fluid from the interior of the working string into the subterranean formation 104.

Although labeled as a terranean surface 102, this surface may be any appropriate surface on Earth (or other planet) from which drilling and completion equipment may be staged to recover hydrocarbons from a subterranean zone. For example, in some aspects, the surface 102 may represent a body of water, such as a sea, gulf, ocean, lake, or otherwise. In some aspects, all are part of a drilling and completion system, including hydraulic fracturing system 100, may be staged on the body of water or on a floor of the body of water (e.g., ocean or gulf floor). Thus, references to terranean surface 102 includes reference to bodies of water, terranean surfaces under bodies of water, as well as land locations.

Subterranean formation 104 includes one or more rock or geologic formations that bear hydrocarbons (e.g., oil, gas) or other fluids (e.g., water) to be produced to the terranean surface 102. For example, the rock or geologic formations can be shale, sandstone, or other type of rock, typically, that may be hydraulically fractured to produce or enhance production of such hydrocarbons or other fluids.

As shown specifically in FIG. 1C, the fracture 110 emanating from the wellbore 108 and the fracture 112 emanating from the wellbore 108 may extend past each other (e.g., overlap in one or two dimensions) when formed. In some aspects, data about the location of such fractures 110 and 112 and the wellbore 108, such as locations of the wellbore, distances between initiation points of the fractures 110 and 112 from the wellbore, depth of the horizontal portion of the wellbore 108, and locations of the hydraulic fractures initiated from the wellbore (e.g., based on perforation locations formed in the wellbores), among other information, may be used, along with pressures measured by the pressure sensors 114 and 115, may be used to determine fracture geometries of the fractures 110 and 112.

In some aspects, such information (along with the monitored, induced pressure variations in a fluid in the one or more monitor wellbores) may be used to help determine one or more dimensions (e.g., fracture length, fracture half-length, fracture height, fracture area) of the hydraulic fractures 112. For example, as shown in FIG. 1C, particular dimensions that comprise a fracture geometry (e.g., a set of values that define a geometry of a hydraulic fracture) are illustrated. In this illustration, $X_f$, represents a half-length of the hydraulic fracture 110. This dimension, as shown, lies in an x-direction in three dimensional space defined under the terranean surface 102. Another dimension, $H_f$, represents a height of the hydraulic fracture 110. This dimension, as shown, lies in a z-direction in three dimensional space defined under the terranean surface 102. Another dimension, $dx_f$, represents a distance between a center 111 of the hydraulic fracture 110 and a radial center 109 of the wellbore 108 in the x-direction. This dimension, as shown, lies in the x-direction in three dimensional space defined under the terranean surface 102. Another dimension, $dz_f$, represents a distance between a center 111 of the hydraulic fracture 110 and a radial center 109 of the wellbore 108 in the z-direction. This dimension, as shown, lies in the z-direction in three dimensional space defined under the terranean surface 102. Another dimension, $dy_f$ (not shown), represents a distance between the center 111 of the hydraulic fracture 110 and a fracture initiation location along the wellbore 108 in the y-direction. This dimension lies in the y-direction in three dimensional space defined under the terranean surface 102. Another dimension that may be part of the fracture geometry is an angle, $\alpha$, that represents the angle between the hydraulic fracture 110 and the wellbore 108. Such dimensions can also be assigned to the fracture 112.

Figure 2:
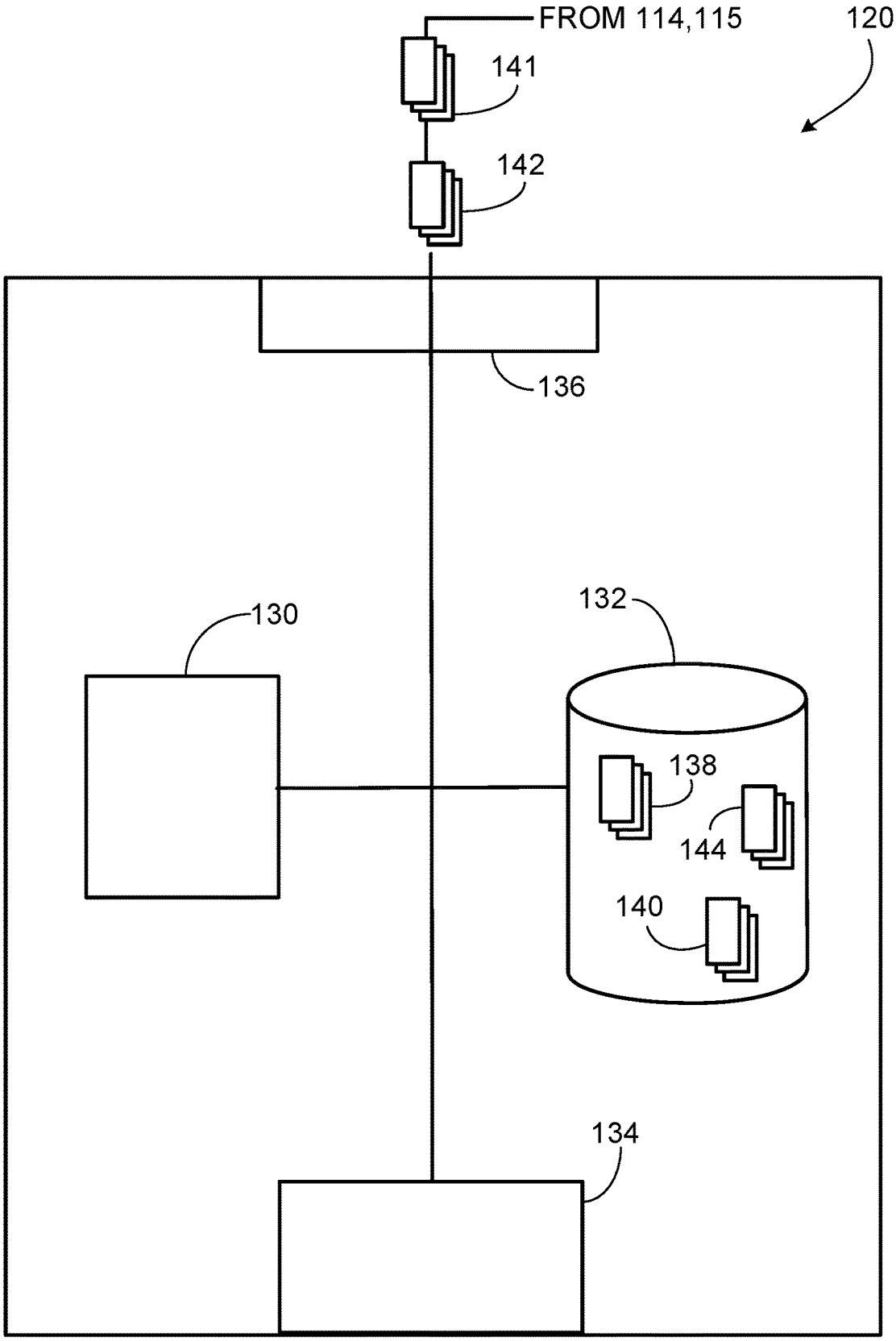
FIG. 2 is a schematic diagram of a computing system that implements the hydraulic fracture geometric modeling system.

FIG. 2 is a schematic diagram of a computing system that implements the hydraulic fracture geometric modeling system 120 shown in FIGS. 1A-1C. Generally, the hydraulic fracture geometric modeling system 120 includes a processor-based control system operable to implement one or more operations described in the present disclosure. As shown in FIG. 2, observed pressure signal values 142 and measured pressure signal values 141 may be received at the hydraulic fracture geometric modeling system 120 (e.g., in real-time during a hydraulic fracturing operation that forms hydraulic fracture 112 or subsequent to such an operation) from the pressure sensors 115 and 114, respectively, that are fluidly coupled to or in the wellbore 108.

The observed pressure signal values 142, in some aspects, may represent pressure variations in a fluid that is enclosed or contained in the hydraulic fracture 110 that are induced by a hydraulic fracturing fluid being used to form hydraulic fracture 112 from the wellbore 108. The observed pressure signal values 142 may be measured or determined by the pressure sensor 115 that is positioned, e.g., between the seal 122 and the toe 119 of the wellbore 108. In some aspects, the observed pressure signals 142 may represent poromechanical interactions between the hydraulic fracture 110 and the hydraulic fracture 112 during the fracturing operation used to form fracture 112. The poromechanical interactions may be identified using observed pressure signals measured by the pressure sensor 115 of a fluid contained in the wellbore 108 (e.g., downhole of the seal 122) or the hydraulic fracture 110.

The measured pressure signal values 141, in some aspects, may represent pressure variations in a fracturing fluid that is used to form the hydraulic fracture 112 during the fracturing operation that forms the hydraulic fracture 112 from the wellbore 108. The measured pressure signal values 141 may be measured or determined by the pressure sensor 114 that is positioned, e.g., between the seal 122 and the entry 117 of the wellbore 108. The measured pressure signal values 141 may represent poromechanical interactions may also be identified using one or more pressure sensors (e.g., sensor 114) or other components that measure a pressure of a hydraulic fracturing fluid used to form the hydraulic fracture 112 from the treatment wellbore 108.

In certain embodiments, each of the observed and measured pressure signals include a pressure versus time curve of the observed pressure signal. Pressure-induced poromechanic signals may be identified in the pressure versus time curve and the pressure-induced poromechanic signals may be used to assess one or more parameters (e.g., geometry) of the hydraulic fracture 112 (and fracture 110).

As used herein, a "pressure-induced poromechanic signal" refers to a recordable change in pressure of a first fluid in direct fluid communication with a pressure sensor (e.g., pressure gauge) where the recordable change in pressure is caused by a change in stress on a solid in a subsurface formation that is in contact with a second fluid (e.g., a hydrocarbon fluid), which is in direct fluid communication with the first fluid. The change in stress of the solid may be caused by a third fluid used in a hydraulic stimulation process (e.g., a hydraulic fracturing process) in a wellbore to form a fracture that is in proximity to (e.g., adjacent) to a previously formed fracture from the wellbore with the third fluid not being in direct fluid communication with the second fluid.

For example, a pressure-induced poromechanic signal may occur in the pressure sensor 115 (where the wellbore 108 has already been hydraulically fractured to create the fracture 110), when the wellbore 108 undergoes hydraulic stimulation to create fracture 112. A particular hydraulic fracture 112 emanating from the wellbore 108 may grow in proximity to the fracture 110 but these fractures do not intersect. No fluid from the hydraulic fracturing process in the wellbore 108 contacts any fluid in the hydraulic fractures 110 and no measureable pressure change in the fluid in the hydraulic fractures 110 is caused by advective or diffusive mass transport related to the hydraulic fracturing process in the wellbore 108. Thus, the interaction of the fluids in the hydraulic fracture 112 with fluids in the subsurface matrix does not result in a recordable pressure change in the fluids in the fracture 110 that can be measured by the pressure sensor 115. The change in stress on a rock (in the subterranean zone 104) in contact with the fluids in the fracture 112, however, may cause a change in pressure in the fluids in the fracture 110, which can be measured as a pressure-induced poromechanic signal in the pressure sensor 115.

Poromechanic signals may be present in traditional pressure measurements taken in the wellbore 108 while fracturing the wellbore 108. For example, if hydraulic fracture 112 overlaps or grows in proximity to hydraulic fracture 110 in fluid communication with the pressure sensor 115 in the wellbore 108, one or more poromechanic signals may be present. However, poromechanic signals may be smaller in nature than a direct fluid communication signal (e.g., a direct observed pressure signal induced by direct fluid communication such as a direct fracture hit or fluid connectivity through a high permeability fault).

Poromechanic signals may also manifest over a different time scale than direct fluid communication signals. Thus, poromechanic signals are often overlooked, unnoticed, or disregarded as data drift or error in the pressure sensor 115. However, such signals may be used, at least in part, to determine a fracture growth curve and other associated fracture dimensions of the hydraulic fractures 112 that emanate from the wellbore 108.

The hydraulic fracture geometric modeling system 120 may be any computing device operable to receive, transmit, process, and store any appropriate data associated with operations described in the present disclosure. The illustrated hydraulic fracture geometric modeling system 120 includes hydraulic fracturing modeling application 130. The application 130 is any type of application that allows the hydraulic fracture geometric modeling system 120 to request and view content on the hydraulic fracture geometric modeling system 120. In some implementations, the application 130 can be and/or include a web browser. In some implementations, the application 130 can use parameters, metadata, and other information received at launch to access a particular set of data associated with the hydraulic fracture geometric modeling system 120. Further, although illustrated as a single application 130, the application 130 may be implemented as multiple applications in the hydraulic fracture geometric modeling system 120.

The illustrated hydraulic fracture geometric modeling system 120 further includes an interface 136, a processor 134, and a memory 132. The interface 136 is used by the hydraulic fracture geometric modeling system 120 for communicating with other systems in a distributed environment—including, for example, the pressure sensors 114 and 115, as well as hydraulic fracturing liquid circulation system 118—that may be connected to a network. Generally, the interface 136 comprises logic encoded in software and/or hardware in a suitable combination and operable to communicate with, for instance, the pressure sensors 114 and 115, a network, and/or other computing devices. More specifically, the interface 136 may comprise software supporting one or more communication protocols associated with communications such that a network or interface's hardware is operable to communicate physical signals within and outside of the hydraulic fracture geometric modeling system 120.

Regardless of the particular implementation, "software" may include computer-readable instructions, firmware, wired or programmed hardware, or any combination thereof on a tangible medium (transitory or non-transitory, as appropriate) operable when executed to perform at least the processes and operations described herein. Indeed, each software component may be fully or partially written or described in any appropriate computer language including C, C++, Java, Visual Basic, ABAP, assembler, Perl, Python, .net, Matlab, any suitable version of 4GL, as well as others. While portions of the software illustrated in FIG. 2 are shown as individual modules that implement the various features and functionality through various objects, methods, or other processes, the software may instead include a number of sub-modules, third party services, components, libraries, and such, as appropriate. Conversely, the features and functionality of various components can be combined into single components as appropriate.

The processor 134 executes instructions and manipulates data to perform the operations of the hydraulic fracture geometric modeling system 120. The processor 134 may be a central processing unit (CPU), a blade, an application specific integrated circuit (ASIC), a field-programmable gate array (FPGA), or another suitable component. Generally, the processor 134 executes instructions and manipulates data to perform the operations of the hydraulic fracture geometric modeling system 120.

Although illustrated as a single memory 132 in FIG. 2, two or more memories may be used according to particular needs, desires, or particular implementations of the hydraulic fracture geometric modeling system 120. In some implementations, the memory 132 is an in-memory database. While memory 132 is illustrated as an integral component of the hydraulic fracture geometric modeling system 120, in some implementations, the memory 132 can be external to the hydraulic fracture geometric modeling system 120. The memory 132 may include any memory or database module and may take the form of volatile or non-volatile memory including, without limitation, magnetic media, optical media, random access memory (RAM), read-only memory (ROM), removable media, or any other suitable local or remote memory component. The memory 132 may store various objects or data, including classes, frameworks, applications, backup data, business objects, jobs, web pages, web page templates, database tables, repositories storing business and/or dynamic information, and any other appropriate information including any parameters, variables, algorithms, instructions, rules, constraints, or references thereto associated with the purposes of the hydraulic fracture geometric modeling system 120.

The illustrated hydraulic fracture geometric modeling system 120 is intended to encompass any computing device such as a desktop computer, laptop/notebook computer, wireless data port, smart phone, smart watch, wearable computing device, personal data assistant (PDA), tablet computing device, one or more processors within these devices, or any other suitable processing device. For example, the hydraulic fracture geometric modeling system 120 may comprise a computer that includes an input device, such as a keypad, touch screen, or other device that can accept user information, and an output device that conveys information associated with the operation of the hydraulic fracture geometric modeling system 120 itself, including digital data, visual information, or a GUI.

As illustrated in FIG. 2, the memory 132 stores data, including one or more data structures 138. In some aspects, the data structures 138 may store structured data that represents or includes, for example, relationships between the wellbore 108 and fractures 112 and fractures 110, the observed pressure signals 142, and the measured pressure signal values 141. For example, in some aspects, each data structure 138 may be or include one or more tables that include information such as the pressure signal values 141 and 142 and an identifier for each of the fractures 110 and 112. In some aspects, each data structure 138 may also include information that represents a relationship between a particular fracture 110, a particular fracture 112, and a particular observed pressure signal 142.

In some aspects, at least one of the data structures 138 stored in the memory 132 may be or include an observation graph. For example, turning to FIGS. 4A-4E (which are discussed in more detail later), these figures show schematic illustrations of example implementations of an observation graph. Generally, each observation graph include nodes and edges. Each node represents a particular hydraulic fracture formed from a particular wellbore within a wellbore system. Each edge represents an observed pressure signal 142. The observation graph illustrates relationships, where each relationship includes two nodes and an edge that connects the two nodes and each relationship is specific to a unique hydraulic fracturing operation. One of the nodes represents a "monitor" fracture (e.g., hydraulic fracture 110) while the other node represents a "treatment" fracture (e.g., hydraulic fracture 112. The edge represents the observed pressure signal 142 generated and measured (e.g., by the sensor 115) at the monitor fracture 110 during the hydraulic fracturing operation that created the treatment fracture 112.

Turning back to FIG. 2, the memory 132, in this example, also stores modeled pressure signals 140 that are, for example, used to calculate or determine hydraulic fracture geometry data 144 (also stored in the memory 132 in this example system). In some aspects, the modeled pressure signals 140 may represent a modeled fluid pressure at a particular hydraulic fracture 110 on the wellbore 108 due to a particular hydraulic fracture 112 being created on the wellbore 108. The modeled fluid pressure may be determined, for example, by a numerical analytical method (e.g., finite element model) that predicts (or models) the fluid pressure at the particular hydraulic fracture 110 on the wellbore 108 due to the particular hydraulic fracture 112 being created on the wellbore 108 based on, for example, the fracturing parameters (e.g., pumped volume of hydraulic fracturing liquid, pressure of pumped hydraulic fracturing liquid, flow rate of hydraulic fracturing liquid, viscosity and density of hydraulic fracturing liquid, geologic parameters, and other data).

Figure 3A:
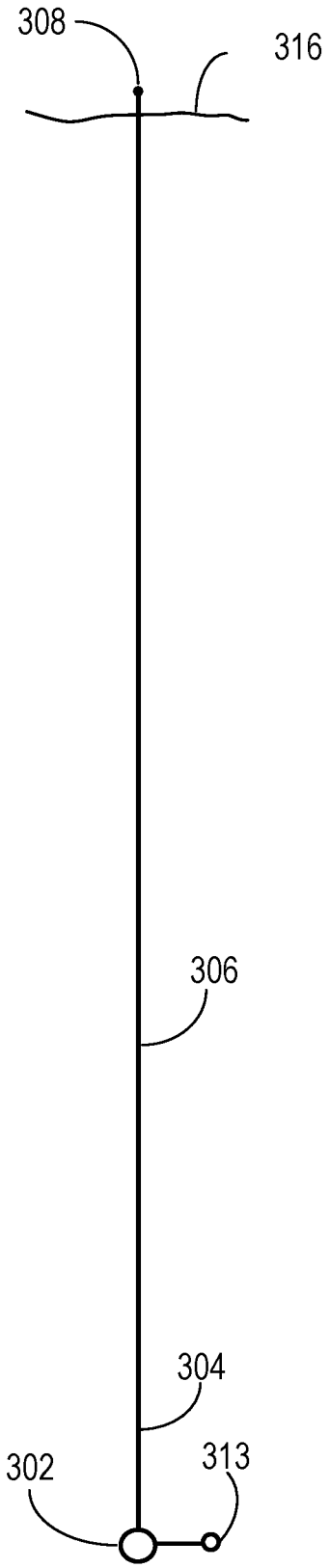
FIGS. 3A-3D illustrate a sequential process for hydraulically fracturing multiple wellbores from which a hydraulic fracture geometric modeling system may determine geometries of the hydraulic fractures.

FIGS. 3A-3D illustrate plan or plat views of a sequential process for hydraulically fracturing a wellbore from which the hydraulic fracture geometric modeling system 120 may determine geometries 144 of hydraulic fractures. For example, FIGS. 3A-3D illustrate an example fracturing process in which the wellbore is sequentially fractured. One or more of the generated fractures may, at times during the process to fracture at least a portion of the wellbore (e.g., between a heel and a toe of the wellbore), a monitor fracture and at other times in the process, a treatment fracture. For instance, as shown in FIG. 3A, a vertical wellbore is formed from an entry location 302 (at a terranean surface). A directional wellbore 306 (having a heel 304 and a toe 308) is formed from the vertical wellbore. Thus, the directional wellbore 306 includes, for example, a radiussed portion and a horizontal portion. In some aspects, the directional wellbore 306 may include a horizontal portion that is maintained in the same rock formation, in different rock formations, at the same true vertical depth (TVD) or at different TVDs. The directional wellbore 306 ends at the toe 308.

Figure 3B:
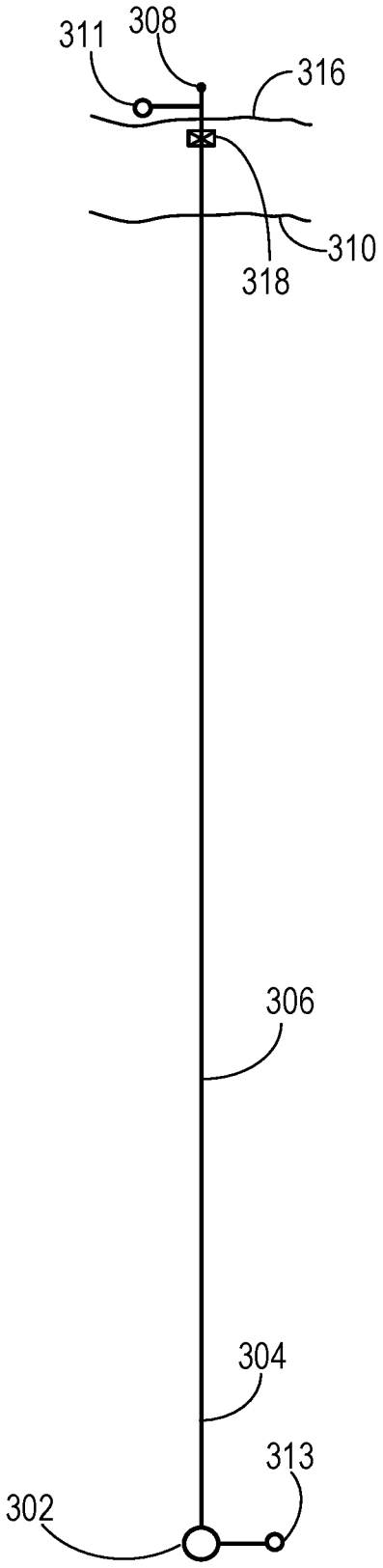

As shown in FIG. 3A, during an initial part of the fracturing operation, wellbore 306 is fractured to create at least one fracture 316 (with fluid pressures measured by a sensor 313 at entry 302). Turning to FIG. 3B, a next part of the fracturing operation commences. As shown, a pressure sensor 311 (such as pressure sensor 115) is shown at or near the hydraulic fracture 316. Another pressure sensor 313 (such as pressure sensor 114) is shown at the entry 302. Further, a seal 318 (e.g., a packer or bridge plug) is set uphole (e.g., toward the heel 304) of the fracture 316. In some aspects, the sensor 311 is placed between the seal 318 and the toe 308 of the wellbore 306.

The hydraulic fracture 316, in FIG. 3B, is considered a monitor (or observation) fracture 316. A hydraulic fracturing operation commences to form treatment fracture 310. During the process to form the fracture 310, pressures observed in the fracture 316 (by the sensor 311) may be stored (e.g., in a data structure) and correlated to the particular fracture 310-fracture 316 combination. Thus, in the example data structure of an observation graph, a two node-one edge combination may include: a designation of the particular monitor (or observation) fracture 316 (e.g., designating the wellbore 306), a designation of the treatment fracture 310, and the observed pressure recorded by the sensor 311 during the operation to create the particular treatment fracture 310.

Figure 3C:
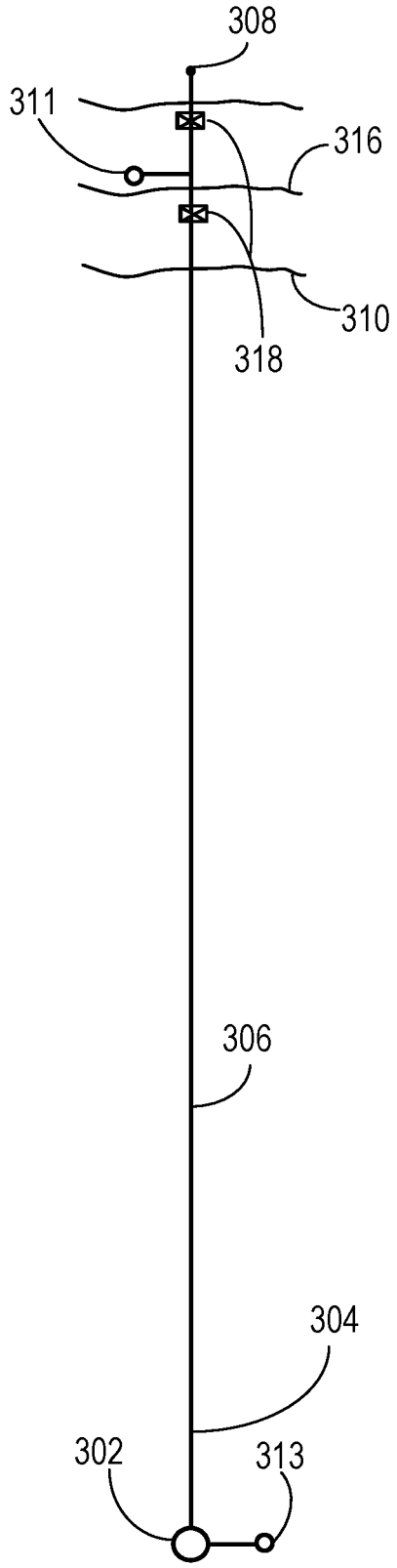

Turning to FIG. 3C, a next part of the fracturing operation commences. As shown, the pressure sensor 311 is moved (or a new sensor is used or placed) to be adjacent the treatment fracture 310 from FIG. 3B, which is now re-labeled as monitor fracture 316. Two seals 318 are positioned to fluidly isolate the monitor fracture 316 in FIG. 3C from other portions of the wellbore 308, such as uphole of the monitor fracture 316. The hydraulic fracture 316, in FIG. 3C, which was a treatment fracture 310 in FIG. 3B, is now monitor fracture 316 in FIG. 3C. Another hydraulic fracturing operation commences to form a new treatment fracture 310. During the process to form the fracture 310, pressures observed in the fracture 316 (by the sensor 311) may be stored (e.g., in a data structure) and correlated to the particular fracture 310-fracture 316 combination. Thus, in the example data structure of the observation graph, another two node-one edge combination may include: a designation of the particular monitor (or observation) fracture 316 (e.g., designating the wellbore 306), a designation of the treatment fracture 310, and the observed pressure recorded by the sensor 311 during the operation to create the particular treatment fracture 310.

Figure 3D:
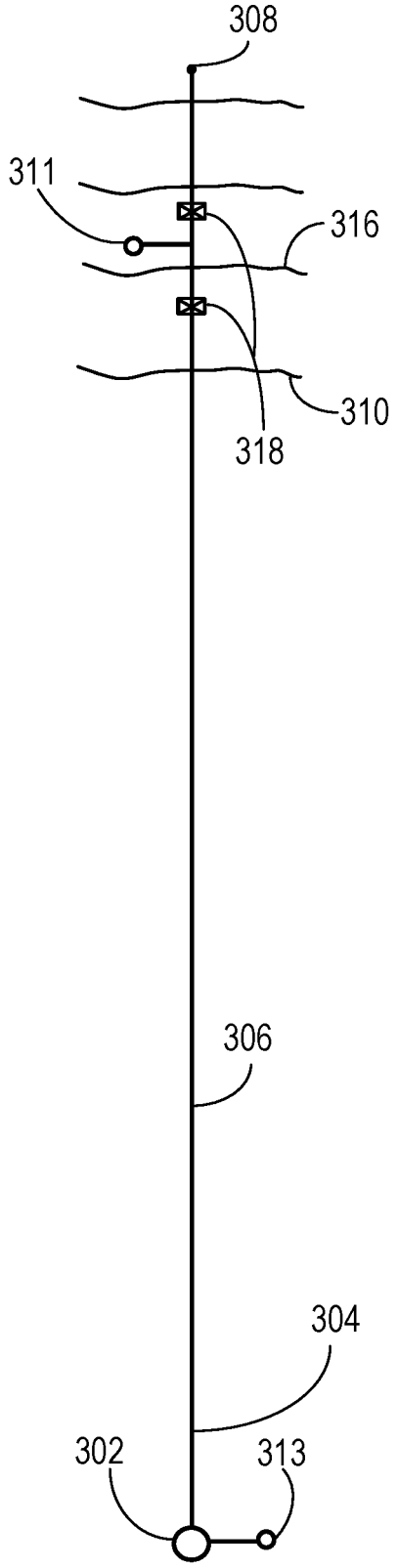

Turning to FIG. 3D, a next part of the fracturing operation commences. As shown, the pressure sensor 311 is moved (or a new sensor is used or placed) to be adjacent the treatment fracture 310 from FIG. 3B, which is now re-labeled as monitor fracture 316. The two seals 318 are positioned (e.g. moved) to fluidly isolate the monitor fracture 316 in FIG. 3C from other portions of the wellbore 308, such as uphole of the monitor fracture 316. The hydraulic fracture 316, in FIG. 3D, which was a treatment fracture 310 in FIG. 3C, is now monitor fracture 316 in FIG. 3D. Another hydraulic fracturing operation commences to form a new treatment fracture 310. During the process to form the fracture 310, pressures observed in the fracture 316 (by the sensor 311) may be stored (e.g., in a data structure) and correlated to the particular fracture 310-fracture 316 combination. Thus, in the example data structure of the observation graph, another two node-one edge combination may include: a designation of the particular monitor (or observation) fracture 316 (e.g., designating the wellbore 306), a designation of the treatment fracture 310, and the observed pressure recorded by the sensor 311 during the operation to create the particular treatment fracture 310.

FIGS. 3A-3D show at least a portion of a process to hydraulically fracture the wellbore 306 while measuring pressure variations in multiple monitor fractures 316. In this example process, each hydraulic fracture is, at one point in the process, a treatment fracture and, at a subsequent point in the process, a monitor fracture. Thus, the example process described with respect to FIGS. 3A-3D is a sequential, serial process with a moving monitor fracture. For example, each completed treatment fracture becomes a monitor fracture to observe a next fracture being completed. Turning to FIG. 4C, an example observation graph 420 is shown that illustrates nodes and edges based on this example serial process. For instance, as shown, each node 422 represents a particular hydraulic fracture in the wellbore. Each edge 424 represents observed pressures within the hydraulic fracture represented at the node 422 connected at a tail of the edge 424 (end without the arrow) during a fracturing process that generates a hydraulic fracture represented at the node 422 connected at a nose of the edge 424 (end with the arrow). For instance, as shown, the node 422 labeled "1" is a monitor fracture during the process that generates the treatment fracture associated with the node 422 labeled "2." The node 422 labeled "2" (which was a treatment fracture relative to the node 422 labeled "1") is a monitor fracture during the process that generates the treatment fracture associated with the node 422 labeled "3." The node 422 labeled "3" (which was a treatment fracture relative to the node 422 labeled "2") is a monitor fracture during the process that generates the treatment fracture associated with the node 422 labeled "4" and so on.

Other example fracturing processes that may produce different observation graphs as compared to observation graph 420 for the same wellbore are also contemplated by the present disclosure. For example, turning to FIG. 4A, an example observation graph 400 is shown that illustrates nodes and edges based on another example hydraulic fracturing process of a wellbore. Observation graph 400, generally, illustrates a "stationary monitor fracture" process in which a single, particular hydraulic fracture is a monitor (or observation) fracture for multiple, subsequent treatment fractures. For instance, as shown, each node 402 represents a particular hydraulic fracture in the wellbore. Each edge 404 represents observed pressures within the hydraulic fracture represented at the node 402 connected at a tail of the edge 404 (end without the arrow) during a fracturing process that generates a hydraulic fracture represented at the node 402 connected at a nose of the edge 404 (end with the arrow). For instance, as shown, the node 402 labeled "1" is a monitor fracture during the process that generates the treatment fracture associated with the node 402 labeled "2." The node 402 labeled "1" is also a monitor fracture during the process that generates the treatment fracture associated with the node 402 labeled "3." The node 402 labeled "1" is also a monitor fracture during the process that generates the treatment fracture associated with the node 402 labeled "4" and so on.

Figure 4A:
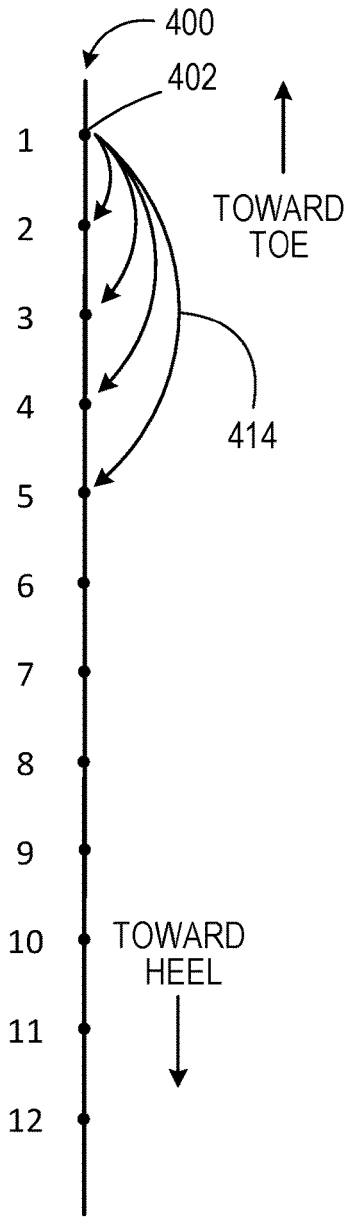
FIGS. 4A-4E are schematic illustrations of example implementations of a data structure that stores structure hydraulic fracturing data from different hydraulic fracturing operation processes within a hydraulic fracture geometric modeling system.
Figure 4B:
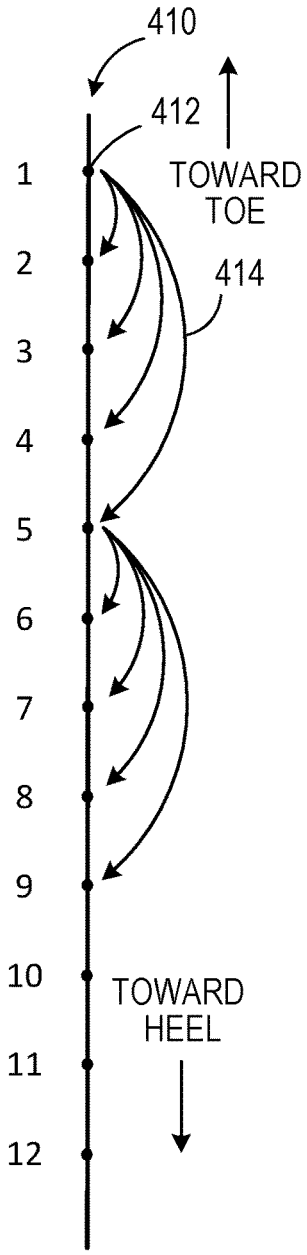
Figure 4C:
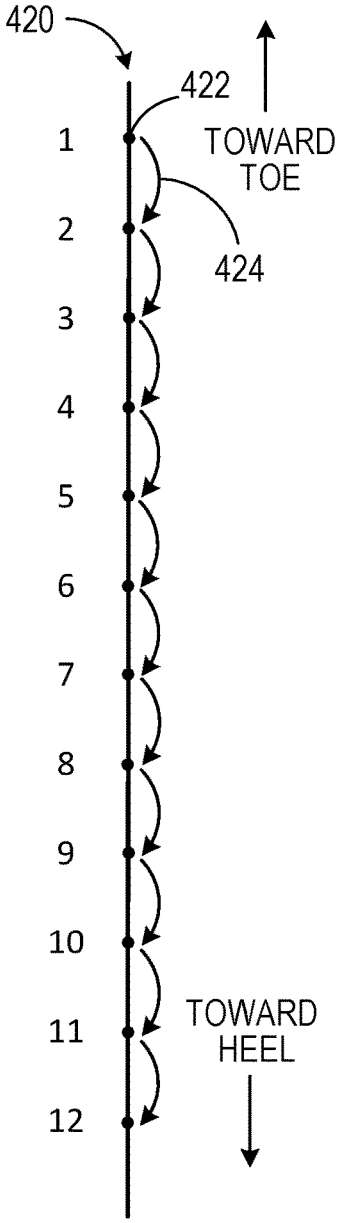

Turning to FIG. 4B, an example observation graph 410 is shown that illustrates nodes and edges based on another example hydraulic fracturing process of a wellbore. Observation graph 410, generally, illustrates a "successive stationary monitor fracture" process in which two or more hydraulic fractures are monitor (or observation) fractures for multiple, subsequent treatment fractures. For instance, as shown, each node 412 represents a particular hydraulic fracture in the wellbore. Each edge 414 represents observed pressures within the hydraulic fracture represented at the node 412 connected at a tail of the edge 414 (end without the arrow) during a fracturing process that generates a hydraulic fracture represented at the node 412 connected at a nose of the edge 414 (end with the arrow). For instance, as shown, the node 412 labeled "1" is a stationary monitor fracture during the processes that generate the treatment fractures associated with the nodes 412 labeled "2," "3," "4," and "5." While the node 412 at "5" is a treatment fracture during the process in which fractures associated with nodes "2," "3," "4," and "5" are formed, it becomes a second, stationary monitor fracture. For example, the node 412 labeled "5" is a stationary monitor fracture during the processes that generate the treatment fractures associated with the nodes 412 labeled "6," "7," "8," and "9."

Figure 4D:
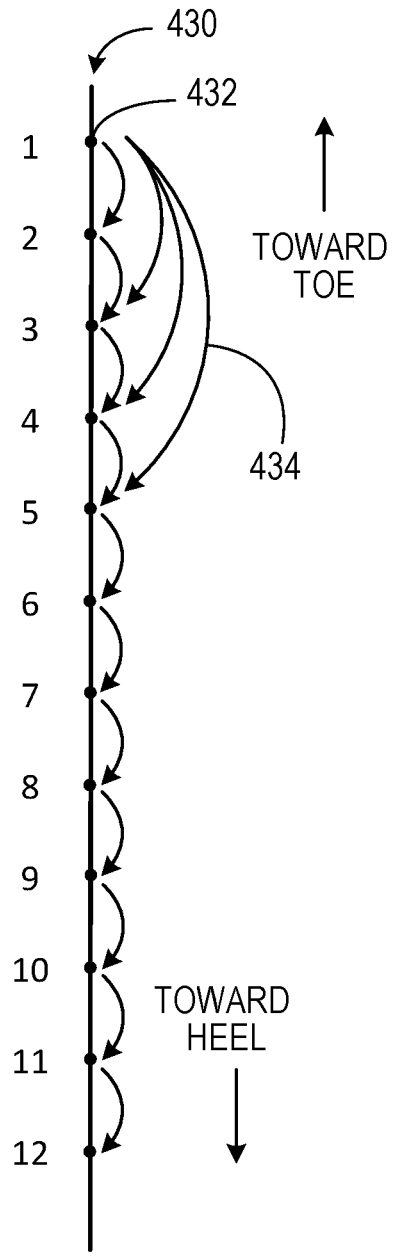

Turning to FIG. 4D, an example observation graph 430 is shown that illustrates nodes and edges based on another example hydraulic fracturing process of a wellbore. Observation graph 430, generally, illustrates a "combined stationary and moving monitor fracture" process in which two or more hydraulic fractures are monitors (or observation) fractures for each subsequent treatment fracture. For instance, as shown, each node 432 represents a particular hydraulic fracture in the wellbore. Each edge 434 represents observed pressures within the hydraulic fracture represented at the node 432 connected at a tail of the edge 434 (end without the arrow) during a fracturing process that generates a hydraulic fracture represented at the node 432 connected at a nose of the edge 434 (end with the arrow).

For instance, as shown, the node 432 labeled "1" is a stationary monitor fracture during the processes that generate the treatment fractures associated with the nodes 432 labeled "2," "3," "4," and "5." During the hydraulic fracturing operations that generate hydraulic fractures at the nodes 432 labeled "2," "3," "4," and "5," there is a monitor fracture in addition to the fracture associated with node 432 labeled "1." For example, as shown, the node 432 labeled "2" (which was a treatment fracture relative to the node 432 labeled "1") is a monitor fracture during the process that generates the treatment fracture associated with the node 432 labeled "3" in addition to the fracture associated with the node 432 labeled "1." The node 432 labeled "3" (which was a treatment fracture relative to the nodes 432 labeled "1" and "2") is a monitor fracture during the process that generates the treatment fracture associated with the node 432 labeled "4" in addition to the fracture associated with the node 432 labeled "1." The node 432 labeled "4" (which was a treatment fracture relative to the nodes 432 labeled "1" and "3") is a monitor fracture during the process that generates the treatment fracture associated with the node 432 labeled "5" in addition to the fracture associated with the node 432 labeled "1," and so on.

Figure 4E:
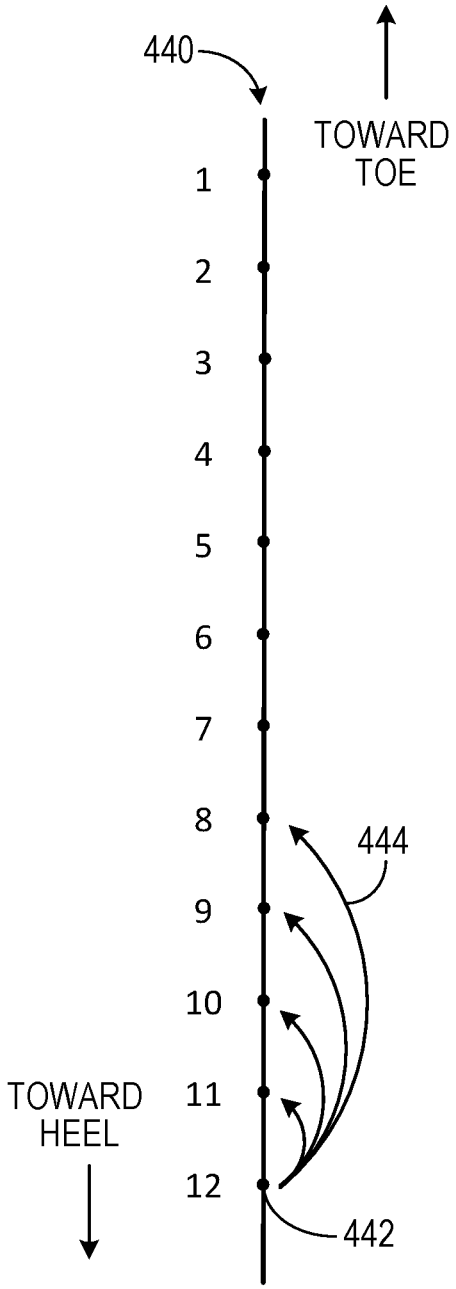

Turning to FIG. 4E, an example observation graph 440 is shown that illustrates nodes and edges based on another example hydraulic fracturing process of a wellbore. Observation graph 440, generally, is similar to the observation graph 400 and the associated process described with reference to FIG. 4A, but, in contrast with that process which describes a "toe positioned" stationary monitor (e.g., the stationary monitor is located at or near a toe end of the wellbore), FIG. 4E illustrates a "heel positioned" stationary monitor (e.g., the stationary monitor is at or near a heel portion of the wellbore). Thus, FIG. 4E also illustrates a "stationary monitor fracture" process in which a single, particular hydraulic fracture is a monitor (or observation) fracture for multiple, subsequent treatment fractures. In some aspects, such a process may be implemented according to the example embodiments of FIG. 8A or 8B (e.g., example embodiments that use a sliding sleeve downhole tool or a flow-through packer tool).

As shown, each node 442 represents a particular hydraulic fracture in the wellbore. Each edge 444 represents observed pressures within the hydraulic fracture represented at the node 442 connected at a tail of the edge 444 (end without the arrow) during a fracturing process that generates a hydraulic fracture represented at the node 442 connected at a nose of the edge 404 (end with the arrow). For instance, as shown, the node 442 labeled "12" is a monitor fracture during the process that generates the treatment fracture associated with the node 442 labeled "11." The node 442 labeled "12" is also a monitor fracture during the process that generates the treatment fracture associated with the node 442 labeled "10." The node 442 labeled "12" is also a monitor fracture during the process that generates the treatment fracture associated with the node 442 labeled "9" and so on.

In some aspects, the fractures associated with nodes 442 may be formed in an "uphole moving" process. For example, subsequent to the formation of the fracture at the node 442 labeled "12," a fracture at the node 442 labeled "1" may be formed. Next, a wellbore seal (e.g., a packer or bridge plug) may be set directly uphole of the node 442 labeled "1." Next, a fracture at the node 442 labeled "2" may be formed. Then, a wellbore seal (e.g., a packer or bridge plug) may be set directly uphole of the node 442 labeled "2." Next, a fracture at the node 442 labeled "3" may be formed. Then, a wellbore seal (e.g., a packer or bridge plug) may be set directly uphole of the node 442 labeled "3," and so on until a fracture at the node 442 labeled "11" is formed. At each formation of fractures at nodes labeled "1" through "11," observed pressures are determined (e.g., by a pressure sensor 115) as are measured pressure values (e.g., by pressure sensor 114) to provide for edge values of the graph 440.

In this example process as described with reference to the observation graph 440, each fracture downhole (e.g., toward the toe at or near the node 442 labeled "1") is generated by fracturing fluid that is circulated from an entry of the wellbore, and past previously formed hydraulic fractures. Thus, in contrast to the system shown in FIGS. 3A-3D (which can produce fractures and observed pressures for any one of the observation graphs 400, 410, 420, and 430) that uses seals (e.g., packers or bridge plugs) to fluidly isolate a monitor fracture from other portions of the wellbore, the hydraulic fracturing process that produces the observation graph 440 may use a sliding sleeve system (as shown and discussed with respect to FIGS. 9A-9D) or flow through packers (as shown in FIGS. 8A-8D) so that fracturing fluid can be circulated downhole past previously formed hydraulic fractures.

Figure 5:
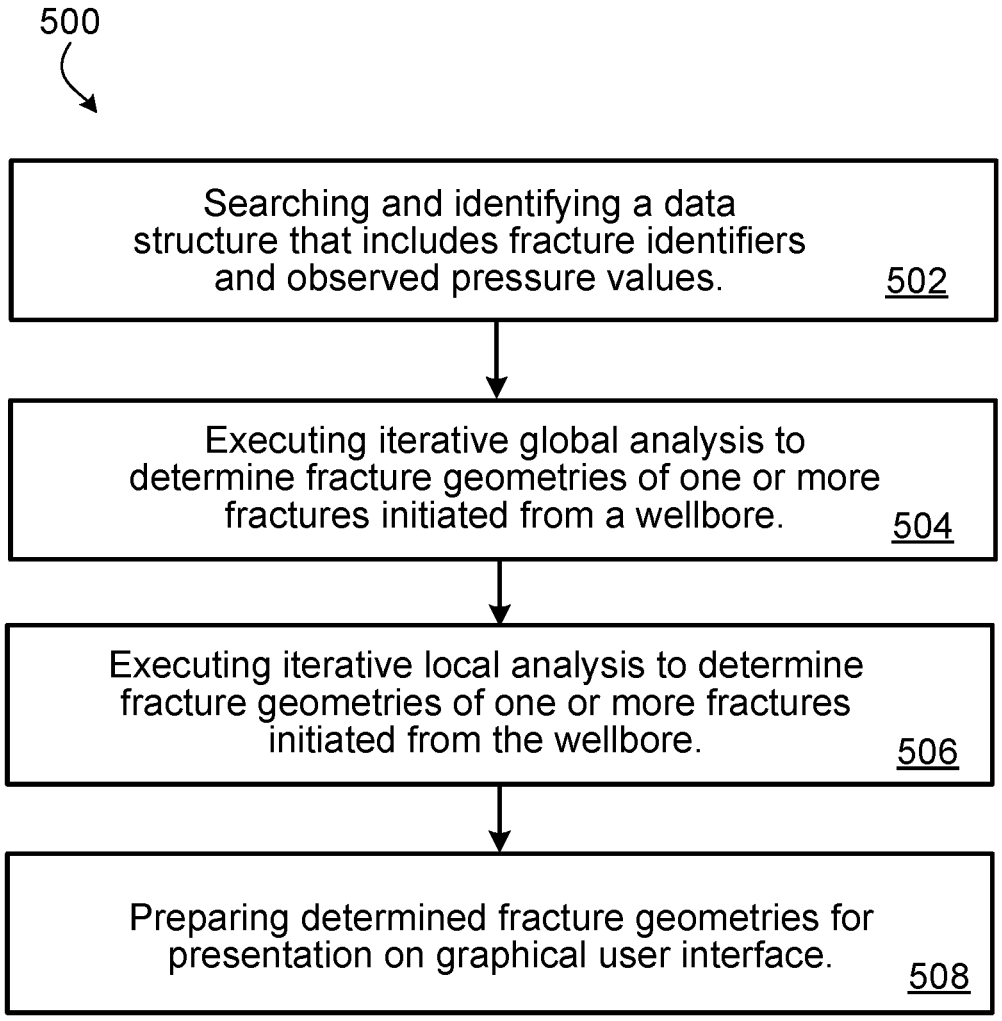
FIGS. 5-7 are flowcharts that illustrate example methods for determining hydraulic fracture geometries.
Figure 6:
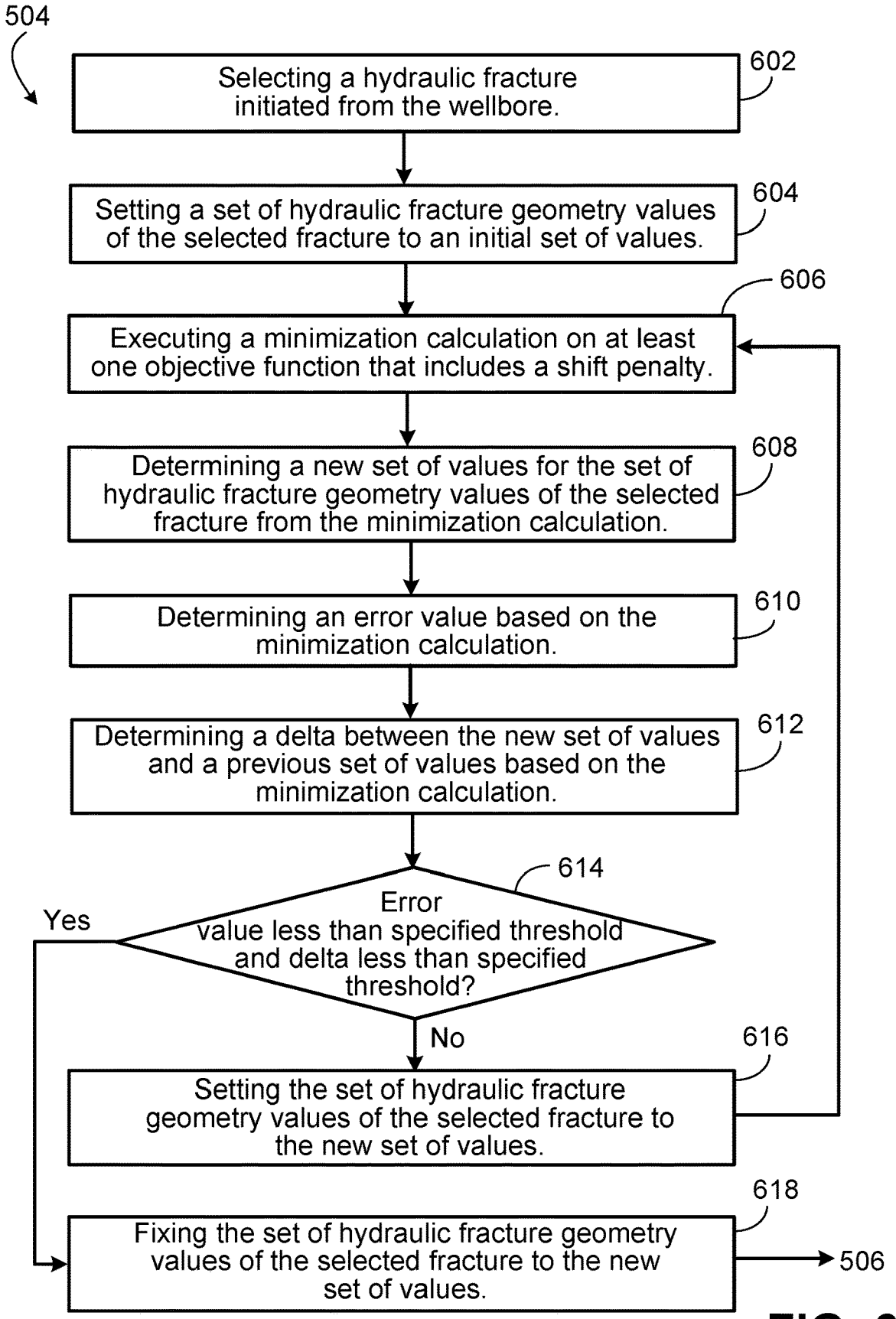
Figure 7:
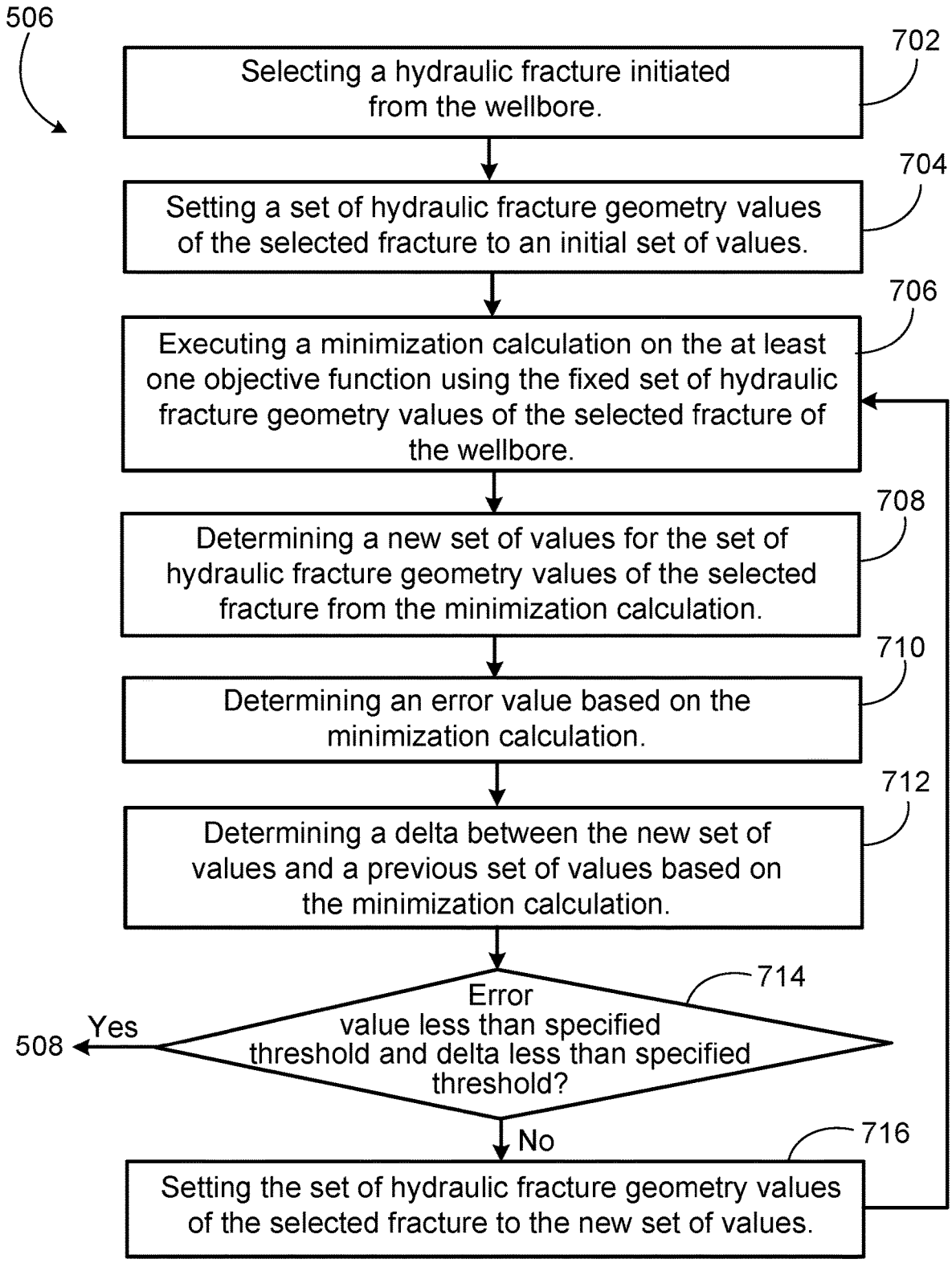

FIGS. 5-7 are flowcharts that illustrate example methods 500, 600, and 700 for determining hydraulic fracture geometries. In some aspects, one or more of methods 500, 600, and 700 can be executed by or with the hydraulic fracture geometric modeling system 120 within a single- or multi objective non-linear constraint optimization analysis (e.g., sequential quadratic programming technique, interior point technique, constrained boundary technique, or otherwise). Method 500 may begin at step 502, which includes searching and identifying a data structure that includes fracture identifiers and observed pressure values. For example, as shown in FIG. 2, one or more data structures 138 may be stored in memory 132. In some examples, the data structures 138 may be observation graphs that store structured data that includes, for example, hydraulic fracture identifiers and observed fluid pressure values. In some aspects, the observation graph may include nodes and edges, with the nodes storing the hydraulic fracture identifying data (e.g., data that indicates a wellbore and a particular fracture) and the edges storing pressure data (e.g., an observed fluid pressure at a particular monitor fracture formed from the wellbore based on a fracturing process to form a treatment fracture from the wellbore).

Method 500 may continue at step 504, which includes executing an iterative global analysis to determine fracture geometries of one or more fractures initiated from the wellbore. For example, in some aspects, fracture geometry of a particular fracture of the wellbore may first be determined or calculated. In some aspects, fracture geometry may include a set of values, including fracture half-length ($X_f$), fracture height ($H_f$), horizontal shift ($dx_f$), vertical shift ($dz_f$), a shift along a wellbore length ($dy_f$), and offset angle ($\alpha$). Thus, a vector, $\Theta$, may represent fracture geometry of any particular fracture, i, with i representing an identifier of the fracture (e.g., with each fracture having a unique identifier):

$$\Theta^i = \begin{Bmatrix} X_f^i \\ H_f^i \\ dx_f^i \\ dy_f^i \\ dz_f^i \\ a_f^i \end{Bmatrix}$$

Turning to FIG. 6, this flowchart represents an example implementation of step 504 (e.g., an iterative global analysis to determine fracture geometries of one or more fractures initiated from the wellbore). The method of step 504 may begin at step 602, which includes selecting a hydraulic fracture initiated from the wellbore. For example, in some aspects, a user may select a particular fracture that emanates from the wellbore. In some aspects, the system 120 may select a particular hydraulic fracture based on, e.g., that fracture's order within the sequence of fractures within the system of fractures. For instance, with reference to FIGS. 3A-3D, the initial monitor fracture 316 shown in FIG. 3B may be selected.

The method of step 504 may continue at step 604, which includes setting a set of hydraulic fracture geometry values of the selected fracture to an initial set of values. For instance, the set of geometry values, $\Theta$, for the selected fracture may be set to feasible values, i.e., values that are feasible given, e.g., wellbore location, fracturing operation parameters (e.g., fluid volume pumped, fluid pressure during fracturing, fluid viscosity and/or density, etc.) present during the fracturing operation that initiated the selected hydraulic fracture.

The method of step 504 may continue at step 606, which includes executing a minimization calculation on at least one objective function that includes a shift penalty. For instance, in some aspects, the values set in step 604, one or more observed pressure values associated with poromechanic pressures measured at the selected hydraulic fracture during fracturing operations to initiate a treatment fracture 316 (e.g., taken from the identified observation graph), and modeled pressure(s) corresponding to the observed fluid pressures (e.g., from the finite element analysis) are set within an objective function.

The objective function may, in some aspects, minimize a difference between the observed pressure values and the modeled pressure values. In some aspects, the objective function may minimize a difference in the mean of the squares of the observed pressure values and the modeled pressure values. For instance, the objective function, $C(\Theta)$, may be defined as:

$$C(\Theta^i) = \frac{1}{m}\sum_{1}^{m}[dP(\Theta_T^i, \Theta_M^i) - MP(\Theta_T^i, \Theta_M^i)]^2, \quad \text{Eq. 1}$$

where, $dP(\Theta_T^i, \Theta_M^i)$ is an observed fluid pressure (e.g., from the observation graph) between the selected monitor (M) fracture and each treatment (T) fracture that the selected monitor fracture "observes" (e.g., experiences a poromechanic fluid pressure during fracturing), and $MP(\Theta_T^i, \Theta_M^i)$ is the modeled fluid pressure (e.g., from the finite element analysis) between the selected monitor fracture and each treatment fracture that the selected monitor fracture observes. In Equation 1, m represents the number of observed pressures.

In some aspects, step 606 may include executing a minimization calculation on a second objective function. For example, the objective function, $C(\Theta)$, described above may be a first objective function ($C^1(\Theta)$), and a second objective function may minimize an absolute difference between a fracture area of the selected hydraulic fracture and a mean fracture area of fractures within a particular group of fractures that include the selected fracture. For instance, the second objective function, $C^2(\Theta)$, may be defined as:

$$C^2(\Theta^i) = \frac{1}{n}\sum_{i=1}^{n}(A^i - \text{mean}(A^i))^2, \quad \text{Eq. 2}$$

where $A^i$ is the fracture area (e.g., the product of $2X_f$ and $H_f$) and n is the number of fractures within a particular group that includes the selected fracture. This objective function, for example, may ensure that the area of each fracture within a fracture group that includes multiple fractures is the same as (or similar to) the mean fracture area of that group (e.g., due to similar or identical fracture operation parameters).

In some aspects, step 606 may include executing a minimization calculation on a third objective function. For example, a third objective function may minimize a standard deviation in a fracture shift (in at least one of the x-, y-, or z-directions) in all of the treatments fractures within a particular group of fractures observed by the selected monitor fracture. For instance, the third objective function, $C^3(\Theta)$, may be defined as:

$$C^3(\Theta^i) = \left(\frac{Std.dev.(dx_f)}{K1}\right)^2 + \left(\frac{Std.dev.(dz_f)}{K2}\right)^2, \quad \text{Eq. 3}$$

where K1 and K2 are constants (adjustable) that account for variances in wellbore location in the underground rock formation.

In some aspects, one, two, or all of the described objective functions may be minimized in step 606. For example, in some aspects, only one of the objective functions (e.g., the first, second, or third) may be minimized in step 606. In other aspects, two of the three objective functions may be minimized in step 606. In other aspects, all three of the objective functions (or other objective functions in accordance with the present disclosure) may be minimized in step 606.

In some aspects, step 606 may include applying a constraint associated with an intersection of the selected fracture and the wellbore. For example, in some aspects, step 604 may require that a center location (e.g., in one or more of the x-, y-, or z-directions) of the selected fracture be no further from a radial center of the wellbore than the fracture half-length ($X_f$) in the x-direction and/or half of the fracture height ($H_f$) in the z-direction. In some aspects, this constraint may be a binary calculation (e.g., pass or fail). If the binary calculation results in a "fail," in some aspects, the system 120 may be programmed to add entropy to the analysis and find a point location near the center location of the selected fracture that is a feasible center location relative to the radial center of the wellbore.

The method of step 504 may continue at step 608, which includes determining a new set of values for the set of hydraulic fracture geometry values of the selected fracture from the minimization calculation. For example, based on the minimization of the one or more objective functions, assessment of the shift penalty, and any other constraints, a new set of geometry values, $\Theta_{k+1}^i$ (with $\Theta_k^i$ representing the previously determined or set vector) is calculated.

The method of step 504 may continue at step 610, which includes determining an error value based on the minimization calculation. For example, in some aspects, as the at least one objective function is minimized to a particular value, the minimized particular value is compared to a particular threshold value (e.g., $1\times10^{-6}$).

The method of step 504 may continue at step 612, which includes determining a delta between the new set of values and a previous set of values based on the minimization calculation. For example, in some aspects, a difference between the previous vector values, $\Theta_k^i$, and the new vector values, $\Theta_{k+1}^i$, are compared according to:

$$\|\Theta_{k+1}^i - \Theta_k^i\| \leq \varepsilon, \quad \text{Eq. 4}$$

where ε is an error threshold value (e.g., $1\times10^{-6}$) and $\|\Theta_{k+1}^i - \Theta_k^i\|$ denotes the L2-error norm of $(\Theta_{k+1}^i - \Theta_k^1)$.

The method of step 504 may continue at step 614, which includes a determination of whether the error value is less than a specified threshold and the delta is less than a specified threshold. If the error values are not satisfied, then the method may continue at step 616, which includes setting the set of hydraulic fracture geometry values of the selected fracture to the new set of values, and returning to step 606. Thus, the method of step 504 may iterate until the error value is less than the specified threshold and the delta is less than the specified threshold.

If such thresholds are satisfied, then the method may continue at step 618, which includes fixing the set of hydraulic fracture geometry values of the selected fracture to the new set of values. Step 618 may continue back to step 506 of method 500.

Step 506 includes executing an iterative local analysis to determine fracture geometries of the treatment fracture. Turning to FIG. 7, this flowchart represents an example implementation of step 506. The method of step 506 may begin at step 702, which includes selecting the treatment fracture, e.g., fracture 112. In some aspects, the system 120 may select a particular hydraulic fracture based on, e.g., that fracture's order within the sequence of fractures within the system of fractures. For instance, with reference to FIGS. 3A-3D, one of the initial treatment fractures 310 shown in FIG. 3B may be selected.

The method of step 506 may continue at step 704, which includes setting a set of hydraulic fracture geometry values of the treatment fracture to an initial set of values. For instance, the set of geometry values, Θ, for the selected fracture may be set to feasible values, i.e., values that are feasible given, e.g., wellbore location, fracturing operation parameters (e.g., fluid volume pumped, fluid pressure during fracturing, fluid viscosity and/or density, etc.) present during the fracturing operation that initiated the selected hydraulic fracture.

The method of step 506 may continue at step 706, which includes executing a minimization calculation on at least one objective function. In this example, for the local analysis, the shift penalty may not be assessed.

For instance, in some aspects, the values set in step 704, one or more observed pressure values associated with poromechanic pressures measured at the selected treatment fracture (e.g., taken from the identified observation graph), and modeled pressure(s) corresponding to the observed fluid pressures (e.g., from the finite element analysis) are set within an objective function.

The objective function may, in some aspects, minimize a difference between the observed pressure values and the modeled pressure values. In some aspects, as with the global analysis, the objective function may minimize a difference in the mean of the squares of the observed pressure values and the modeled pressure values. For instance, the objective function, $C(\Theta)$, may be defined as:

$$C(\Theta^i) = \frac{1}{m}\sum_{1}^{m}[dP(\Theta_T^i, \Theta_M^i) - MP(\Theta_T^i, \Theta_M^i)]^2, \quad \text{Eq. 1}$$

where, $dP(\Theta_T^i, \Theta_M^i)$ is an observed fluid pressure (e.g., from the observation graph) between the selected monitor (M) fracture and the treatment (T) fracture(s) that the selected monitor fracture "observes" (e.g., experiences a poromechanic fluid pressure during fracturing), and $MP(\Theta_T^i, \Theta_M^i)$ is the modeled fluid pressure (e.g., from the finite element analysis) between the selected monitor fracture and the treatment fracture(s) that the selected monitor fracture observes. In Equation 1, m represents the number of observed pressures.

In some aspects, step 706 may include executing a minimization calculation on a second objective function. For example, the objective function, $C(\Theta)$, describe above may be a first objective function ($C^1(\Theta)$), and a second objective function may minimize an absolute difference between a fracture area of the selected hydraulic fracture and a mean fracture area of the fractures within a particular fracture group that includes the selected fracture. For instance, the second objective function, $C^2(\Theta)$, may be defined as:

$$C^2(\Theta^i) = \frac{1}{n}\sum_{i=1}^{n}(A^i - \text{mean}(A^i))^2, \quad \text{Eq. 2}$$

where $A^i$ is the fracture area (e.g., the product of $2X_f$ and $H_f$) and n is the number of fractures within a particular group that includes the selected fracture. This objective function, for example, may ensure that the area of each fracture within a fracture group that includes multiple fractures is the same (or similar) as the mean fracture area of that group (e.g., due to similar or identical fracture operation parameters).

In some aspects, one or both of the described objective functions may be minimized in step 706. For example, in some aspects, only one of the objective functions (e.g., the first or second) may be minimized in step 706. In other aspects, both of the objective functions may be minimized in step 706.

In some aspects, step 706 may include applying a constraint associated with an intersection of the selected fracture and the monitor wellbore. For example, in some aspects, step 604 may require that a center location (e.g., in one or more of the x-, y-, or z-directions) of the selected fracture be no further from a radial center of the wellbore than the fracture half-length ($X_f$) in the x-direction and/or half of the fracture height ($H_f$) in the z-direction. In some aspects, this constraint may be a binary calculation (e.g., pass or fail). If the binary calculation results in a "fail," in some aspects, the system 120 may be programmed to add entropy to the analysis and find a point location near the center location of the selected fracture that is a feasible center location relative to the radial center of the wellbore.

The method of step 506 may continue at step 708, which includes determining a new set of values for the set of hydraulic fracture geometry values of the selected fracture from the minimization calculation. For example, based on the minimization of the one or more objective functions and any other constraints, a new set of geometry values, $\Theta_{k+1}^i$ (with $\Theta_k^i$ representing the previously determined or set vector) is calculated.

The method of step 506 may continue at step 710, which includes determining an error value based on the minimization calculation. For example, in some aspects, as the at least one objective function is minimized to a particular value, the minimized particular value is compared to a particular threshold value (e.g., $1\times10^{-6}$).

The method of step 506 may continue at step 712, which includes determining a delta between the new set of values and a previous set of values based on the minimization calculation. For example, in some aspects, a difference between the previous vector values, $\Theta_k^i$, and the new vector values, $\Theta_{k+1}^i$, are compared according to:

$$\|\Theta_{k+1}^i - \Theta_k^i\| \leq \varepsilon, \quad \text{Eq. 4}$$

where $\varepsilon$ is an error threshold value (e.g., $1\times10^{-6}$) and $\|\Theta_{k+1}^i - \Theta_k^i\|$ denotes the L2-error norm of $(\Theta_{k+1}^i - \Theta_k^1)$.

The method of step 506 may continue at step 714, which includes a determination of whether the error value is less than a specified threshold and the delta is less than a specified threshold. If the error values are not satisfied, then the method may continue at step 716, which includes setting the set of hydraulic fracture geometry values of the selected fracture to the new set of values, and returning to step 706. Thus, the method of step 506 may iterate until the error value is less than the specified threshold and the delta is less than the specified threshold.

If such thresholds are satisfied, then the method may continue to step 508. Step 508 includes preparing the determined fracture geometries for presentation on a graphical user interface (GUI).

Method 500 may include further operations and steps as well. For example, in some aspects, the determined fracture geometries may be presented to a hydraulic fracture treatment operator, as well as recommendations based on the determined geometries. For instance, recommendations may include adjusting one or more parameters of the current hydraulic fracturing operation in the wellbore 108 or a future hydraulic fracturing operation (e.g., in wellbore 108 or another wellbore).

FIGS. 8A-8D are schematic plat views of a portion 800 of another example implementation of a hydraulic fracturing system that includes a flow through packer 804 and provides pressure data to a hydraulic fracture geometric modeling system, such as the hydraulic fracture geometric modeling system 120. More specifically, FIGS. 8A-8D illustrate a process by which several treatment fractures 810*a*-810*d* are formed, e.g., starting from a toe end of a wellbore 802 and progressing uphole toward a heel end of the wellbore 802. During fracturing operations to form the treatment fractures 810*a*-810*d*, fluid pressures in a monitor fracture 808 may be measured by a pressure sensor 804 that is in fluid communication with the fluid in the monitor fracture 808. Also, during fracturing operations to form the treatment fractures 810*a*-810*d*, fracturing fluid pressures in the wellbore 802 may be measured by a pressure sensor (not shown) mounted in the wellbore 802, such as at an entry of the wellbore 802 at a surface.

Figure 8A:
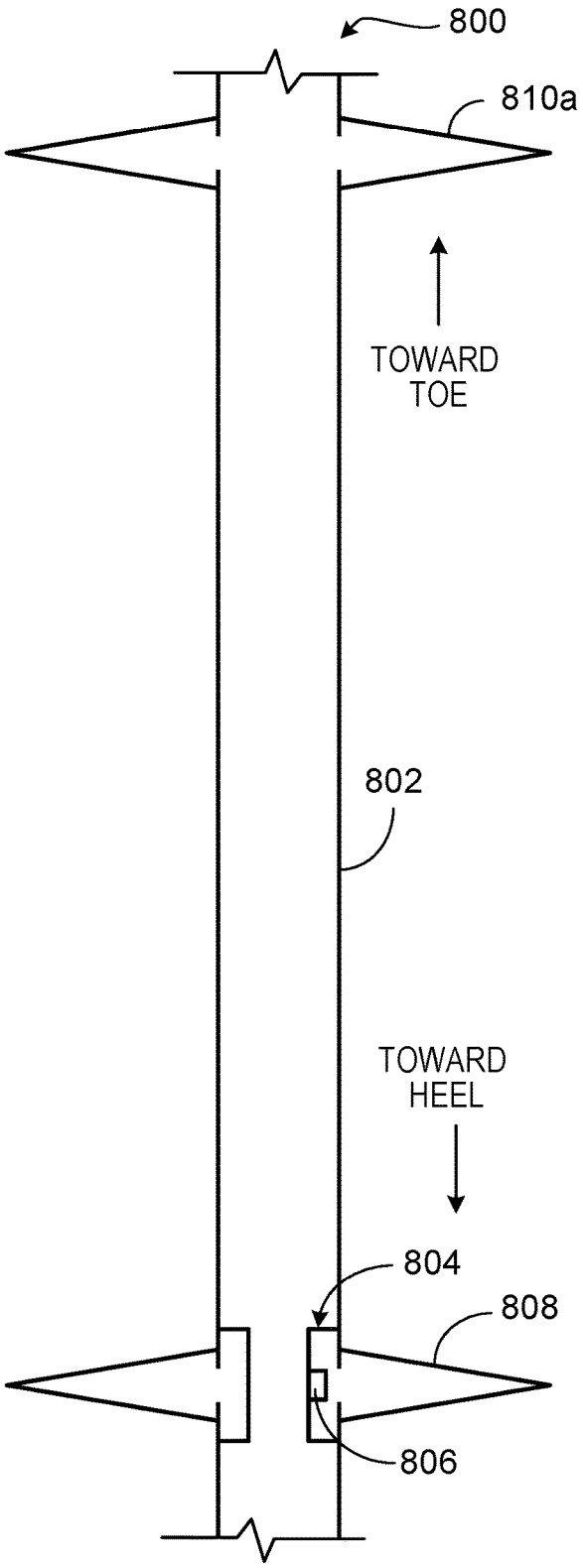
FIGS. 8A-8D are schematic plat views of a portion of another example implementation of a hydraulic fracturing system that includes a flow through packer and provides pressure data to a hydraulic fracture geometric modeling system.

Turning specifically to FIG. 8A, once the monitor fracture 808 is formed, a flow through packer 804 is positioned in the wellbore 802 so as to seal the fracture 808 from the interior volume of the wellbore 802, as shown. The pressure sensor 806 is mounted, in this example, within the flow through packer 806 in order to measure a pressure of fluid in the monitor fracture 808 during the fracturing operation that generates treatment fracture 810*a*. Such pressure values may be then stored or recorded in an observation graph (e.g., observation graph 440).

Figure 8B:
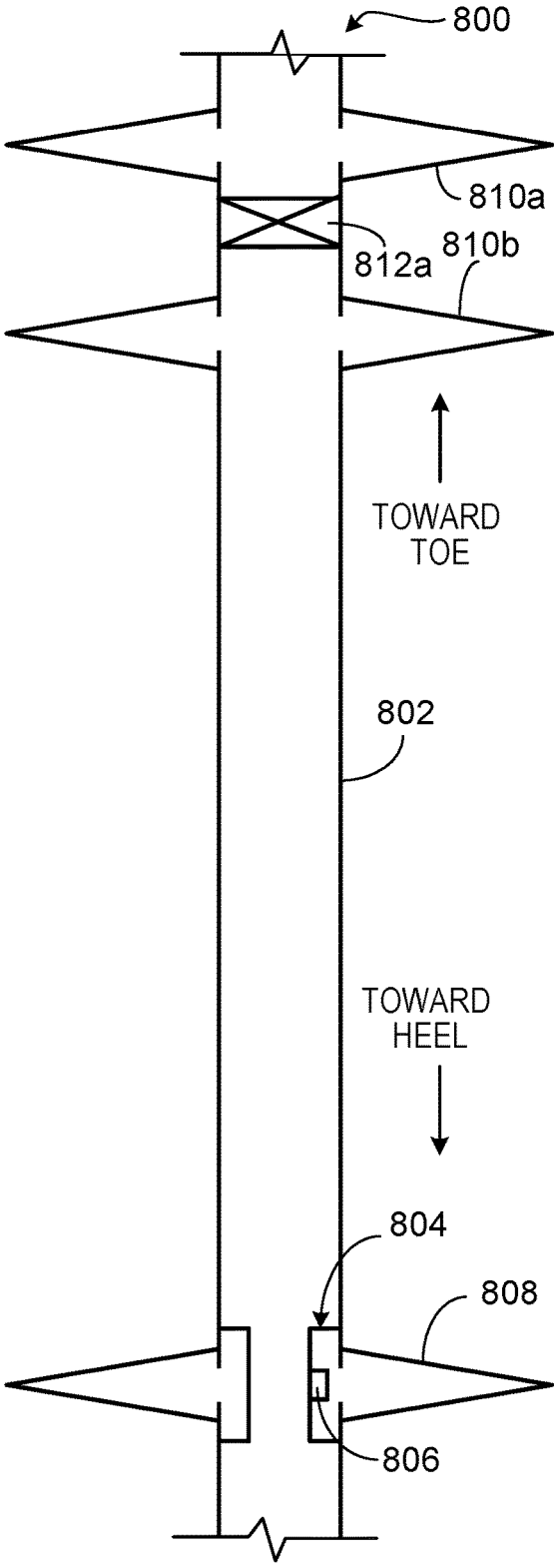

Turning now to FIG. 8B, after formation of the first treatment fracture 810*a*, a wellbore seal 812*a* (e.g., a packer or bridge plug) may be set in the wellbore uphole of the fracture 810*a*. Another fracturing operation may commence to form a second treatment fracture 810*b*. The pressure sensor 806 within the flow through packer 806 measures a pressure of fluid in the monitor fracture 808 during the fracturing operation that generates treatment fracture 810*b*. Such pressure values may be then stored or recorded in an observation graph (e.g., observation graph 440).

Figure 8C:
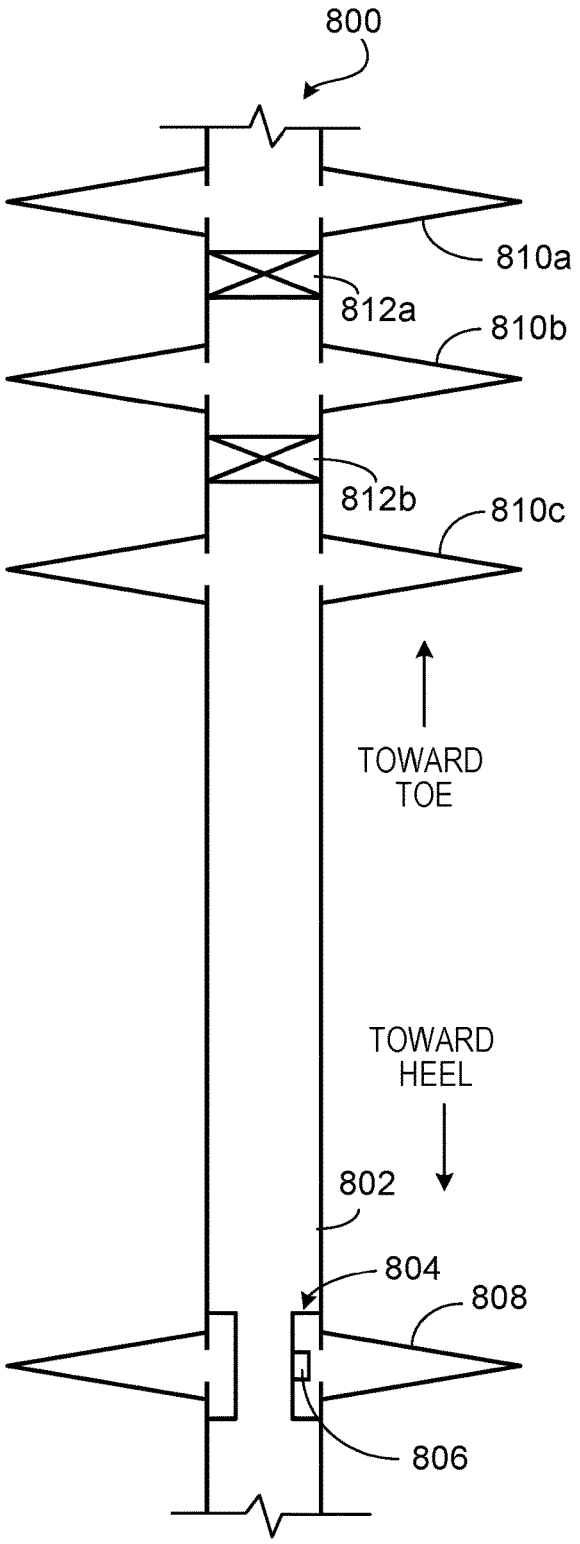

Turning now to FIG. 8C, after formation of the second treatment fracture 810*b*, another wellbore seal 812*b* (e.g., a packer or bridge plug) may be set in the wellbore uphole of the fracture 810*b*. Alternatively, wellbore seal 812*a* may be moved to be uphole of the treatment fracture 810*b*. Another fracturing operation may commence to form a third treatment fracture 810*c*. The pressure sensor 806 within the flow through packer 806 measures a pressure of fluid in the monitor fracture 808 during the fracturing operation that generates treatment fracture 810*c*. Such pressure values may be then stored or recorded in an observation graph (e.g., observation graph 440).

Figure 8D:
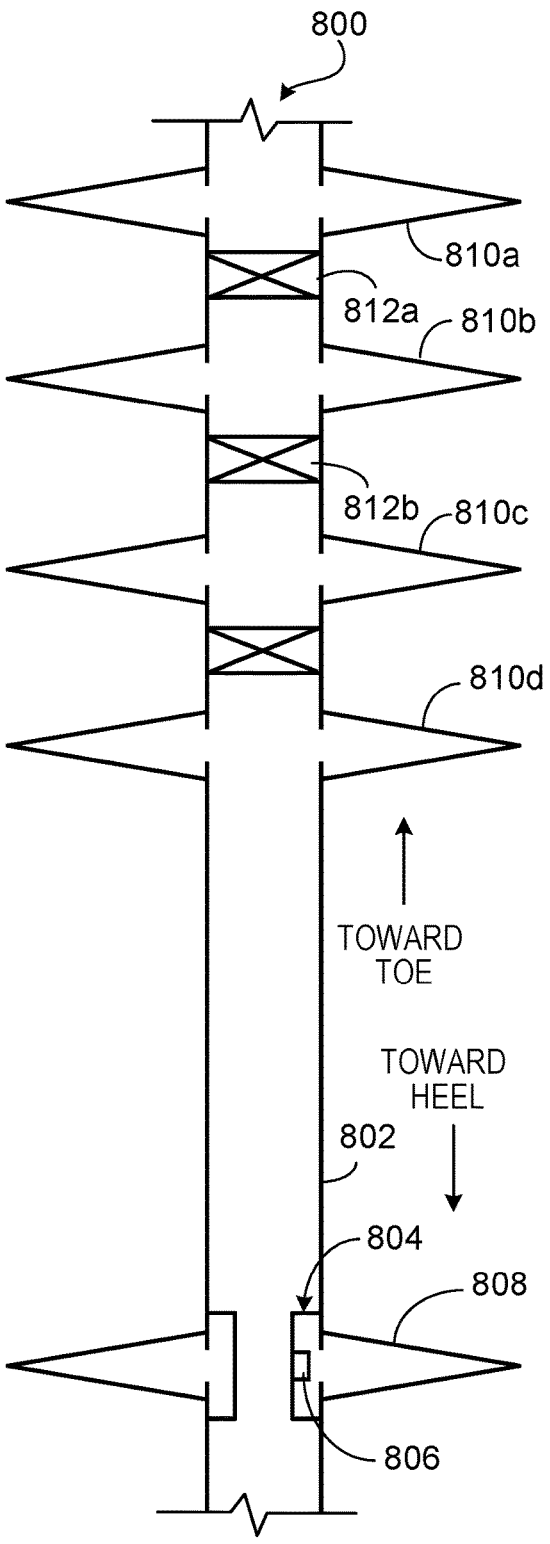

Turning now to FIG. 8D, after formation of the third treatment fracture 810*c*, another wellbore seal 812*c* (e.g., a packer or bridge plug) may be set in the wellbore uphole of the fracture 810*c*. Alternatively, wellbore seal 812*a* may be moved to be uphole of the treatment fracture 810*c*. Another fracturing operation may commence to form a fourth treatment fracture 810*d*. The pressure sensor 806 within the flow through packer 806 measures a pressure of fluid in the monitor fracture 808 during the fracturing operation that generates treatment fracture 810*d*. Such pressure values may be then stored or recorded in an observation graph (e.g., observation graph 440). The process described with reference to FIGS. 8A-8D may, in some aspects, continue beyond four treatment fractures.

Figure 9A:
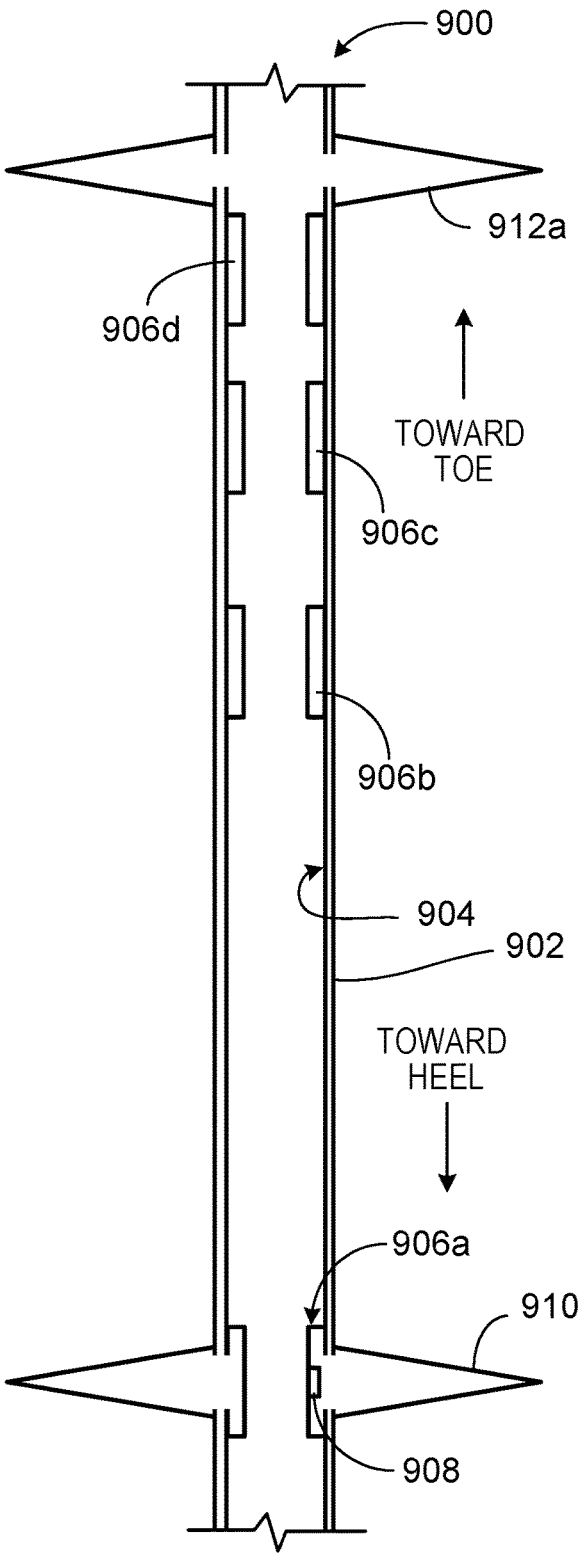
FIGS. 9A-9C are schematic plat views of a portion of another example implementation of a hydraulic fracturing system that includes a sliding sleeve downhole tool and provides pressure data to a hydraulic fracture geometric modeling system.
Figure 9B:
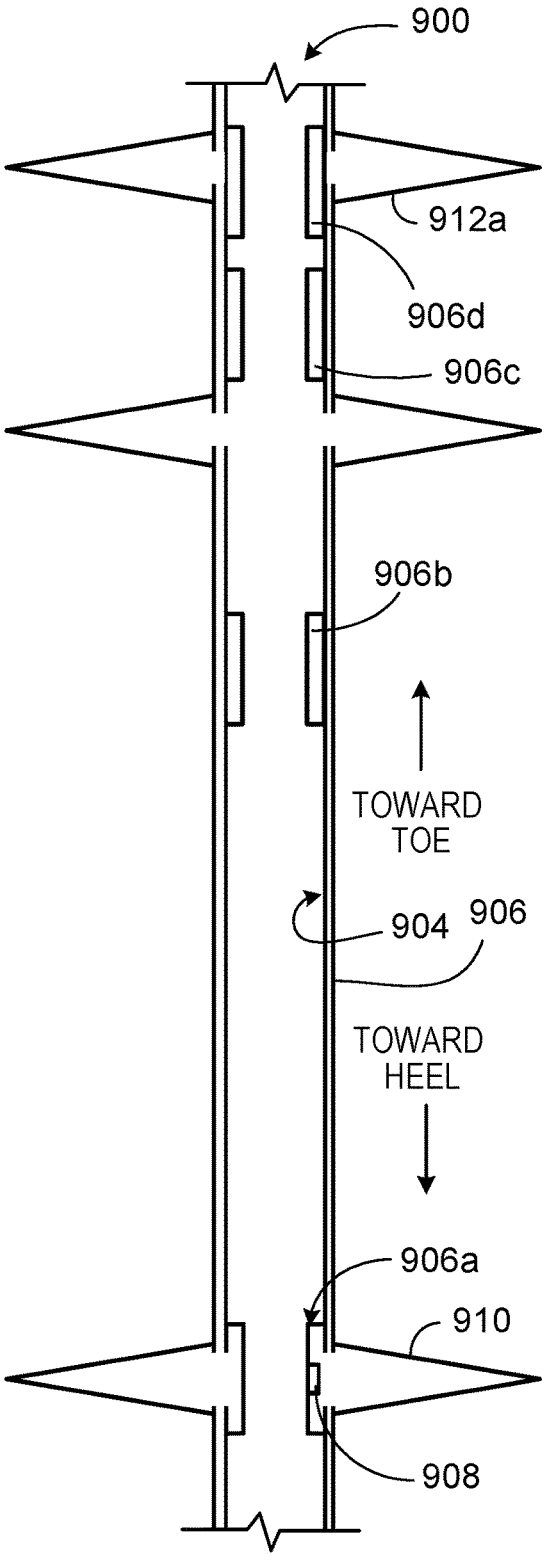
Figure 9C:
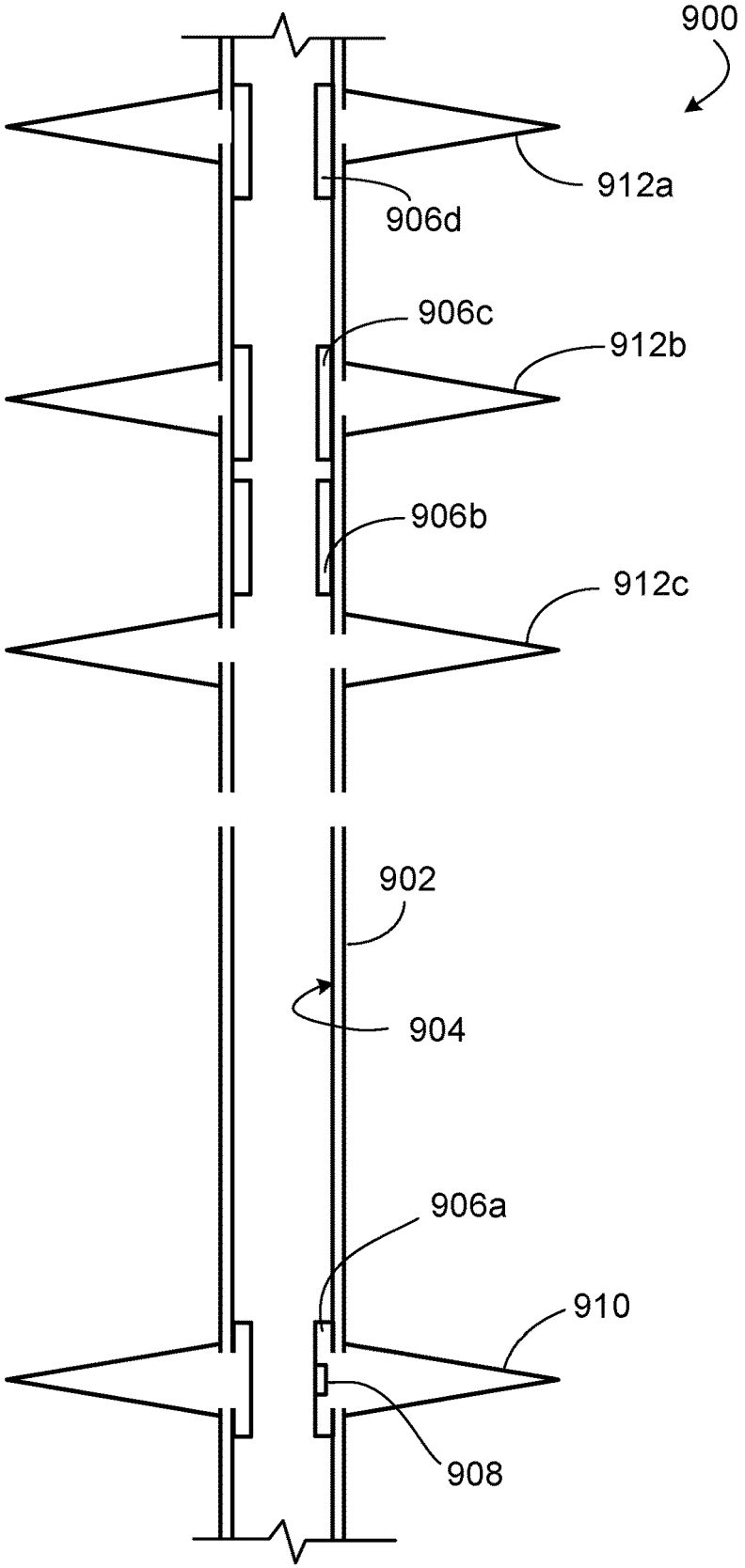

FIGS. 9A-9C are schematic plat views of a portion 900 of another example implementation of a hydraulic fracturing system that includes a sliding sleeve downhole tool 904 and provides pressure data to a hydraulic fracture geometric modeling system, such as the hydraulic fracture geometric modeling system 120. More specifically, FIGS. 9A-9C illustrate a process by which several treatment fractures 912*a*-912*c* are formed, e.g., starting from a toe end of a wellbore 902 and progressing uphole toward a heel end of the wellbore 902. During fracturing operations to form the treatment fractures 912*a*-912*c*, fluid pressures in a monitor wellbore 910 may be measured by a pressure sensor 908 that is in fluid communication with the fluid in the monitor fracture 910. Also, during fracturing operations to form the treatment fractures 912*a*-912*c*, fracturing fluid pressures in the wellbore 902 may be measured by a pressure sensor (not shown) mounted in the wellbore 902, such as at an entry of the wellbore 902 at a surface.

This embodiment also includes the sliding sleeve downhole tool 904 that includes one or more sliding sleeves 906*a*-906*d*. In some aspects, the sliding sleeve downhole tool 904 may be a MultiCycle® frac sleeve made by NCS Multistage of 19450 State Highway 249, Suite 200, Houston, Tex. 77070. In other aspects, the sliding sleeve downhole tool 904 may be a tool that includes a tubular mandrel on which several sleeves may be mounted and actuated (e.g., mechanically or hydraulically) to slide in one or both directions (e.g., uphole and downhole) on the tubular mandrel.

Turning specifically to FIG. 9A, once the monitor fracture 910 is formed, a sleeve 906*a* is positioned (e.g., mechanically or hydraulically) on the downhole tool 904 so as to seal the fracture 910 from the interior volume of the wellbore 902, as shown. The pressure sensor 908 is mounted, in this example, within the sleeve 906*a* in order to measure a pressure of fluid in the monitor fracture 910 during the fracturing operation that generates treatment fracture 912*a*. Such pressure values may be then stored or recorded in an observation graph (e.g., observation graph 440).

Turning now to FIG. 9B, after formation of the first treatment fracture 912*a*, a sliding sleeve 906*d* is moved (e.g., mechanically or hydraulically) to seal the fracture 912*a* from the interior volume of the wellbore 902, as shown. Another fracturing operation may commence to form a second treatment fracture 912*b*. The pressure sensor 908 within the sleeve 906*a* measures a pressure of fluid in the monitor fracture 910 during the fracturing operation that generates treatment fracture 912*b*. Such pressure values may be then stored or recorded in an observation graph (e.g., observation graph 440).

Turning now to FIG. 9C, after formation of the second treatment fracture 912*b*, a sliding sleeve 906*c* is moved (e.g., mechanically or hydraulically) to seal the fracture 912*b* from the interior volume of the wellbore 902, as shown. Another fracturing operation may commence to form a third treatment fracture 912*c*. The pressure sensor 908 within the sleeve 906*a* measures a pressure of fluid in the monitor fracture 910 during the fracturing operation that generates treatment fracture 912*c*. Such pressure values may be then stored or recorded in an observation graph (e.g., observation graph 440). The process described with reference to FIGS. 9A-9C may, in some aspects, continue beyond three treatment fractures.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A wellbore system, comprising:

a first hydraulic fracture formed from a wellbore at a first location;

a second hydraulic fracture formed from the wellbore at a second location of the wellbore;

at least one wellbore seal positioned in the wellbore between the first and second locations and configured to fluidly seal a first portion of the wellbore that includes the first location from a second portion of the wellbore that includes the second location;

a pressure gauge positioned in the first portion of the wellbore;

a pressure gauge positioned in or uphole of the second portion of the wellbore; and a control system configured to communicably couple to the pressure gauges and further configured to perform operations comprising:

identifying a set of first pressure values recorded by the pressure gauge positioned in the first portion of the wellbore during a hydraulic fracturing operation that forms the second hydraulic fracture;

identifying at least one second pressure value recorded by the pressure gauge positioned in the second portion of the wellbore during the hydraulic fracturing operation that forms the second hydraulic fracture;

based on the identified set of first pressure values and the at least one second pressure value, determining one or more fracture geometries of the second hydraulic fracture; and generating a graphical representation of the one or more fracture geometries of the second hydraulic fracture for display on a graphical user interface.

2. The wellbore system of claim 1, wherein the at least one wellbore seal comprises a first wellbore seal, the system further comprising a second wellbore seal positioned in the wellbore between the first portion of the wellbore and another portion of the wellbore between the first hydraulic fracture and a toe of the wellbore and configured to fluidly seal the first portion of the wellbore that includes the first location from the toe of the wellbore.

3. The wellbore system of claim 2, further comprising a third wellbore seal positioned in the wellbore between the second portion of the wellbore and a third portion of the wellbore that includes a third location of the wellbore and configured to fluidly seal the second portion of the wellbore from the third portion of the wellbore.

4. The wellbore system of claim 3, wherein the third portion of the wellbore is uphole of the second portion of the wellbore.

5. The wellbore system of claim 3, further comprising:

a third hydraulic fracture formed from the wellbore at the third location; and a pressure gauge positioned in or uphole of the third portion of the wellbore.

6. The wellbore system of claim 5, wherein the control system is configured to perform further operations comprising:

identifying a set of second pressure values recorded by the pressure gauge positioned in the second portion of the wellbore during a hydraulic fracturing operation that forms the third hydraulic fracture;

identifying at least one third pressure value recorded by the pressure gauge positioned in or uphole of the third portion of the wellbore during the hydraulic fracturing operation that forms the third hydraulic fracture;

based on the at least one third pressure value and at least one of: (i) the identified set of first pressure values, or (ii) the identified set of second pressure values, determining one or more fracture geometries of the third hydraulic fracture; and generating a graphical representation of the one or more fracture geometries of the third hydraulic fracture for display on a graphical user interface.

7. The wellbore system of claim 6, wherein the operation of determining one or more fracture geometries of the third hydraulic fracture comprises:

based on the at least one third pressure value, the identified set of first pressure values, and the identified set of second pressure values, determining one or more fracture geometries of the third hydraulic fracture.

8. The wellbore system of claim 1, wherein the at least one wellbore seal comprises a bridge plug.

9. The wellbore system of claim 1, wherein the pressure gauge positioned in or uphole of the second portion of the wellbore is positioned at or near an entry location of the wellbore at a terranean surface.

10. A method for determining one or more hydraulic fracture geometries, comprising:

forming a first hydraulic fracture that emanates from a wellbore at a first location of the wellbore;

fluidly sealing a first portion of the wellbore that includes the first location from a second portion of the wellbore that includes a second location of the wellbore;

forming a second hydraulic fracture that emanates from the wellbore at the second location;

during the formation of the second hydraulic fracture: (i) measuring a set of first pressure values recorded by a pressure gauge positioned in the first portion of the wellbore, and (ii) measuring at least one second pressure value recorded by a pressure gauge positioned in or uphole of the second portion of the wellbore;

based on the measured set of first pressure values and the measured at least one second pressure value, determining one or more fracture geometries of the second hydraulic fracture; and generating a graphical representation of the one or more fracture geometries of the second hydraulic fracture for display on a graphical user interface.

11. The method of claim 10, further comprising:

fluidly sealing the first portion of the wellbore from another portion of the wellbore between the first hydraulic fracture and a toe of the wellbore.

12. The method of claim 10, further comprising:

fluidly sealing the second portion of the wellbore from a third portion of the wellbore that includes a third location of the wellbore.

13. The method of claim 12, wherein the third portion of the wellbore is uphole of the second portion of the wellbore.

14. The method of claim 13, further comprising:

forming a third hydraulic fracture that emanates from the wellbore at the third location;

during the formation of the third hydraulic fracture: (i) measuring a set of second pressure values recorded by a pressure gauge positioned in the second portion of the wellbore, and (ii) measuring at least one third pressure value recorded by a pressure gauge positioned in or uphole of the third portion of the wellbore;

based on the measured set of second pressure values and the measured at least one third pressure value, determining one or more fracture geometries of the third hydraulic fracture; and generating a graphical representation of the one or more fracture geometries of the third hydraulic fracture for display on the graphical user interface.

15. The method of claim 10, wherein fluidly sealing the first portion of the wellbore that includes the first location from the second portion of the wellbore that includes the second location of the wellbore comprises setting a wellbore seal within the wellbore between the first and second locations.

16. The method of claim 15, wherein the wellbore seal comprises a bridge plug.

17. The method of claim 10, wherein the pressure gauge positioned in or uphole of the second portion of the wellbore is positioned at or near an entry location of the wellbore at a terranean surface.

18. The method of claim 10, further comprising forming the wellbore that extends from a terranean surface into a subsurface rock formation.

19. A structured data processing system for determining geometries of hydraulic fractures, the system comprising:

one or more hardware processors;

a memory in communication with the one or more hardware processors, the memory storing a data structure and an execution environment, the data structure storing data that comprises a plurality of hydraulic fracture identifiers and a plurality of observed fluid pressures, at least one of the plurality of hydraulic fracture identifiers associated with a first hydraulic fracture formed from a wellbore that extends from a terranean surface into a subsurface rock formation and at least another of the plurality of hydraulic fracture identifiers associated with a second hydraulic fracture formed from the wellbore, at least one of the plurality of observed fluid pressures comprising a pressure change in a fluid in the first hydraulic fracture that is induced by formation of the second hydraulic fracture, the execution environment comprising:

a hydraulic fracture geometry solver configured to perform operations comprising:

(i) executing a single- or multi-objective, non-linear constrained optimization analysis to minimize at least one objective function associated with the plurality of observed fluid pressures, and (ii) based on minimizing the at least one objective function, determining respective sets of hydraulic fracture geometries associated with at least one of the first hydraulic fracture or the second hydraulic fracture;

a user interface module that generates a user interface that renders one or more graphical representations of the determined respective sets of hydraulic fracture geometries; and a transmission module that transmits, over one or more communication protocols and to a remote computing device, data that represents the one or more graphical representations.

20. The structured data processing system of claim 19, wherein the at least one objective function comprises a first objective function, and minimizing the first objective function comprises:

minimizing a difference between the observed pressure and a modeled pressure associated with the first and second hydraulic fractures.

21. The structured data processing system of claim 19, wherein the hydraulic fracture geometry solver is further configured to perform operations comprising assessing a shift penalty to the first objective function.

22. The structured data processing system of claim 19, wherein the operation of assessing the shift penalty comprises minimizing a standard deviation of a center location of each of a plurality of hydraulic fractures initiated from the wellbore that includes the second hydraulic fracture.

23. The structured data processing system of claim 19, wherein the modeled pressure is determined with a finite element method that outputs the modeled pressure based on inputs that comprise parameters of a hydraulic fracture operation and the respective sets of hydraulic fracture geometries of the first and second hydraulic fractures.

24. The structured data processing system of claim 23, wherein the hydraulic fracture geometry solver is further configured to perform operations comprising applying a constraint to the single- or multi-objective, non-linear constrained optimization analysis associated with at least one of a center of the first hydraulic fracture or a center of the second hydraulic fracture.

25. The structured data processing system of claim 24, wherein the operation of applying the constraint comprises at least one of:

constraining a distance between the center of the first hydraulic fracture and the radial center of the wellbore to be no greater than a fracture half-length dimension of the first hydraulic fracture and no greater than a fracture height dimension of the first hydraulic fracture; or constraining a distance between the center of the second hydraulic fracture and the radial center of the wellbore to be no greater than a fracture half-length dimension of the second hydraulic fracture and no greater than a fracture height dimension of the second hydraulic fracture.

26. The structured data processing system of claim 19, wherein the hydraulic fracture geometry solver is further configured to perform operations comprising minimizing a second objective function associated with at least one of an area of the first or second hydraulic fracture.

27. The structured data processing system of claim 26, wherein the operation of minimizing the second objective function comprises:

minimizing a difference between the area of the first hydraulic fracture and an average area of a group of hydraulic fractures that includes the second hydraulic fracture; or minimizing a difference between the area of the second hydraulic fracture and an average area of the group of hydraulic fractures that includes the second hydraulic fracture.

28. The structured data processing system of claim 19, wherein the hydraulic fracture geometry solver is further configured to perform operations comprising iterating steps (i) and (iii) until at least one of:

(a) the value of at least one of the first or second objective functions is less than a specified value;

(b) the value of at least one of the first or second objective functions is greater than a specified value;

(c) a ratio of at least one of the first or second objective functions to a specified value is a finite number;

(d) the ratio of a specified number to at least one of the first or second objective functions is a finite number; or (e) a change in the determined plurality of fracture geometry data for the first hydraulic fracture from a previous iteration to a current iteration is less than the specified value.

29. The structured data processing system of claim 28, wherein the operation of iterating comprises:

setting the set of hydraulic fracture geometries of the first hydraulic fracture to an initial set of data values;

minimizing at least one of the first or second objective functions using the observed pressure and modeled pressure that is based on the set of hydraulic fracture geometries of the first hydraulic fracture and a set of hydraulic fracture geometries of the second hydraulic fracture;

calculating a new set of hydraulic fracture geometries of the first hydraulic based on the minimization; and resetting the set of hydraulic fracture geometries of the first hydraulic fracture to the calculated new set of hydraulic fracture geometries.

30. The structured data processing system of claim 29, wherein the operation of determining respective sets of hydraulic fracture geometries associated with at least one of the first hydraulic fracture or the second hydraulic fracture comprises determining respective sets of hydraulic fracture geometries associated with the first hydraulic fracture.

31. The structured data processing system of claim 30, wherein the hydraulic fracture geometry solver is further configured to perform operations comprising:

based on the error for at least one of the first or second objective functions being less than the specified value, fixing the set of hydraulic fracture geometries of the first hydraulic fracture to the calculated new set of hydraulic fracture geometries;

minimizing the first objective function to minimize the difference between the observed pressure and the modeled pressure associated with the first and second hydraulic fractures; and minimizing the second objective function to minimize the difference between the area of the second hydraulic fracture and the average area of the group of hydraulic fractures that comprises the second hydraulic fracture.

32. The structured data processing system of claim 31, wherein the hydraulic fracture geometry solver is further configured to perform operations comprising iterating steps (i) and (ii) until:

an error for at least one of the first or second objective functions is less than a specified value; and a change in the determined plurality of fracture geometry data for the second hydraulic fracture from a previous iteration to a current iteration is less than the specified value.

33. The structured data processing system of claim 32, wherein the operation of iterating comprises:

setting the set of hydraulic fracture geometries of the second hydraulic fracture to an initial set of data values;

minimizing at least one of the first or second objective functions using the observed pressure and modeled pressure that is based on the fixed set of hydraulic fracture geometries of the first hydraulic fracture and the set of hydraulic fracture geometries of the second hydraulic fracture;

calculating a new set of hydraulic fracture geometries of the second hydraulic fracture based on the minimization; and resetting the set of hydraulic fracture geometries of the second hydraulic fracture to the calculated new set of hydraulic fracture geometries.

34. The structured data processing system of claim 19, wherein the hydraulic fracture geometry solver is further configured to perform operations comprising iterating steps (i) and (iii) until a change in the determined plurality of fracture geometry data for the first hydraulic fracture from a previous iteration to a current iteration is less than the specified value and at least one of:

(a) the value of at least one of the first or second objective functions is less than a specified value;

(b) the value of at least one of the first or second objective functions is greater than a specified value;

(c) a ratio of at least one of the first or second objective functions to a specified value is a finite number; or (d) the ratio of a specified number to at least one of the first or second objective functions is a finite number.

35. The structured data processing system of claim 19, wherein the single- or multi-objective, non-linear constrained optimization analysis comprises a sequential quadratic programming method.

36. The structured data processing system of claim 19, wherein the data structure comprises an observation graph that comprises a plurality of nodes and a plurality of edges, each edge connecting two nodes.

37. The structured data processing system of claim 36, wherein each node represents one of the plurality of hydraulic fractures and each edge represents one of the observed pressures.

* * * * *